US012076614B2

(12) United States Patent
Lagree

(10) Patent No.: US 12,076,614 B2
(45) **Date of Patent: *Sep. 3, 2024**

(54) SYSTEM AND METHOD OF USING TWO EXERCISE MACHINES

(71) Applicant: Lagree Technologies, Inc., Chatsworth, CA (US)

(72) Inventor: Sebastien Anthony Louis Lagree, Chatsworth, CA (US)

(73) Assignee: Lagree Technologies, Inc., Chatsworth (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/341,038

(22) Filed: Jun. 26, 2023

(65) Prior Publication Data

US 2023/0330479 A1 Oct. 19, 2023

Related U.S. Application Data

(63) Continuation of application No. 17/565,754, filed on Dec. 30, 2021, now Pat. No. 11,691,048, which is a (Continued)

(51) Int. Cl.
*A63B 22/20* (2006.01)
*A63B 21/00* (2006.01)
(Continued)

(52) U.S. Cl.
CPC ..... *A63B 22/203* (2013.01); *A63B 21/00065* (2013.01); *A63B 21/0428* (2013.01);
(Continued)

(58) Field of Classification Search
CPC ..... A63B 21/00065; A63B 21/0428; A63B 22/203; A63B 22/0002; A63B 22/0007;
(Continued)

(56) References Cited

U.S. PATENT DOCUMENTS 1,621,477 A 8/1925 Pilates
3,559,986 A * 2/1971 Ehrmantraut .... A63B 23/03533 482/70

(Continued)

FOREIGN PATENT DOCUMENTS

WO 2004/096376 A1 11/2004

*Primary Examiner* — Megan Anderson
(74) *Attorney, Agent, or Firm* — Neustel Law Offices

(57) ABSTRACT

A system and method of using two exercise machines for performing a wide range of exercise movements that utilize both of the exercise machines in concert. The system and method of using two exercise machines generally includes first exercise machine and a second exercise machine which are used in concert to perform a wide range of exercise movements. The first exercise machine may include a track, a carriage movably connected to the track, and an end platform. The second exercise machine may include its own separate track, a carriage movably connected to the track, and an end platform. The exercise machines may be positioned side-to-side in parallel orientation such that an exerciser may perform various exercise moves by positioning different limbs on the respective carriages, end platforms, and/or tracks of the exercise machines, in addition to the surface underlying the exercise machines.

13 Claims, 26 Drawing Sheets

Related U.S. Application Data continuation of application No. 16/917,134, filed on Jun. 30, 2020, now Pat. No. 11,213,719.

(51) Int. Cl.
*A63B 21/04* (2006.01)
*A63B 22/00* (2006.01)
*A63B 23/035* (2006.01)

(52) U.S. Cl.
CPC .. *A63B 23/03541* (2013.01); *A63B 21/00047* (2013.01); *A63B 21/4045* (2015.10); *A63B 2022/0038* (2013.01); *A63B 2022/0041* (2013.01)

(58) Field of Classification Search
CPC ..... A63B 22/001; A63B 22/0012; A63B 23/03541; A63B 2022/0038; A63B 2022/0041; A63B 2022/0043
See application file for complete search history.

(56) References Cited

U.S. PATENT DOCUMENTS 3,770,267 A 11/1973 McCarthy
4,679,786 A 7/1987 Rodgers
4,759,540 A 7/1988 Yu
4,798,378 A 1/1989 Jones
5,066,005 A 11/1991 Luecke
5,263,913 A 11/1993 Boren
D362,700 S 9/1995 Breibart
D382,319 S 8/1997 Gerschefske
5,681,249 A 10/1997 Endelman
5,885,197 A 3/1999 Barton
5,967,955 A 10/1999 Westfall
6,179,753 B1 1/2001 Barker
7,163,500 B2 1/2007 Endelman
7,803,095 B1 9/2010 Lagree
7,931,570 B2 4/2011 Hoffman
8,249,714 B1 8/2012 Hartman
8,500,611 B2 8/2013 Hoffman
8,585,554 B2 11/2013 Shavit
9,011,296 B2 * 4/2015 Peralo ..... A63B 23/03575 482/123
9,022,909 B2 * 5/2015 Kermath ..... A63B 21/0428 482/133
9,265,986 B1 2/2016 Godak
10,046,193 B1 8/2018 Aronson
11,154,749 B1 10/2021 Lagree
11,161,001 B1 11/2021 Lagree
2001/0056011 A1 12/2001 Endelman
2003/0119635 A1 6/2003 Arbuckle
2005/0130810 A1 6/2005 Sands
2005/0164856 A1 7/2005 Parmater
2006/0046914 A1 3/2006 Endelman
2006/0199712 A1 9/2006 Barnard
2007/0087921 A1 4/2007 Graham
2008/0070765 A1 3/2008 Brown
2008/0248935 A1 10/2008 Solow
2010/0227748 A1 9/2010 Campanaro
2011/0009249 A1 1/2011 Campanaro
2011/0143898 A1 6/2011 Trees
2011/0166002 A1 7/2011 Savsek
2011/0172069 A1 7/2011 Gerschefske
2012/0295771 A1 11/2012 Lagree
2013/0196835 A1 8/2013 Solow
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0157452 A1 6/2017 Lagree
2017/0157458 A1 6/2017 Lagree
2017/0165518 A1 6/2017 Lagree
2017/0165555 A1 6/2017 Lagree
2017/0189740 A1 7/2017 Lagree
2017/0189741 A1 7/2017 Lagree
2017/0209728 A1 7/2017 Lagree
2017/0239526 A1 8/2017 Lagree
2017/0246491 A1 8/2017 Lagree
2017/0246499 A1 8/2017 Lagree
2017/0296865 A1 10/2017 Lagree
2017/0304673 A1 10/2017 Lagree
2017/0326406 A1 11/2017 Lagree
2017/0340947 A1 11/2017 Lagree
2017/0354840 A1 12/2017 Lagree
2018/0015319 A1 1/2018 Lagree
2018/0021621 A1 1/2018 Lagree
2018/0021655 A1 1/2018 Lagree
2018/0036583 A1 2/2018 Lagree
2018/0056109 A1 3/2018 Lagree
2018/0056133 A1 3/2018 Lagree
2018/0111020 A1 4/2018 Lagree
2018/0111033 A1 4/2018 Lagree
2018/0117392 A1 5/2018 Lagree
2018/0133532 A1 5/2018 Lagree
2018/0133533 A1 5/2018 Lagree
2018/0133534 A1 5/2018 Lagree
2018/0133542 A1 5/2018 Lagree
2018/0178053 A1 6/2018 Lagree
2018/0193691 A1 7/2018 Lagree
2018/0250551 A1 9/2018 Lagree
2018/0250573 A1 9/2018 Lagree
2018/0272179 A1 9/2018 Lagree
2018/0280782 A1 10/2018 Lagree
2018/0318627 A1 11/2018 Lagree
2018/0318646 A1 11/2018 Lagree
2018/0326252 A1 11/2018 Lagree
2018/0353803 A1 12/2018 Lagree
2018/0361190 A1 12/2018 Lagree
2018/0361197 A1 12/2018 Lagree
2019/0083842 A1 3/2019 Lagree
2019/0160320 A1 5/2019 Lagree
2019/0160329 A1 5/2019 Lagree

(56) References Cited

U.S. PATENT DOCUMENTS

| | | | |
|---|---|---|---|
| 2019/0232105 | A1 | 8/2019 | Lagree |
| 2019/0240530 | A1 | 8/2019 | Lagree |
| 2019/0247694 | A1 | 8/2019 | Lagree |
| 2019/0247705 | A1 | 8/2019 | Lagree |
| 2019/0247707 | A1 | 8/2019 | Lagree |
| 2019/0255375 | A1 | 8/2019 | Lagree |
| 2019/0269961 | A1 | 9/2019 | Lagree |
| 2019/0314672 | A1 | 10/2019 | Lagree |
| 2019/0358484 | A1 | 11/2019 | Lagree |
| 2020/0030657 | A1 | 1/2020 | Lagree |
| 2020/0047051 | A1 | 2/2020 | Lagree |
| 2020/0054913 | A1 | 2/2020 | Lagree |
| 2020/0078630 | A1 | 3/2020 | Lagree |
| 2020/0078634 | A1 | 3/2020 | Lagree |
| 2020/0171337 | A1 | 6/2020 | Lagree |
| 2021/0086022 | A1 | 3/2021 | Williams |

* cited by examiner

SYSTEM AND METHOD OF USING TWO EXERCISE MACHINES

CROSS REFERENCE TO RELATED APPLICATIONS

The present application is a continuation of U.S. application Ser. No. 17/565,754 filed on Dec. 30, 2021 which issues as U.S. Pat. No. 11,691,048 on Jul. 4, 2023, which is a continuation of U.S. application Ser. No. 16/917,134 filed on Jun. 30, 2020 now issued as U.S. Pat. No. 11,213,719. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a system and method of using two exercise machines for performing a wide range of exercise movements that utilize both of the exercise machines in concert.

RELATED ART

Any discussion of the related art throughout the specification should in no way be considered as an admission that such related art is widely known or forms part of common general knowledge in the field.

Exercise machines have been in use for centuries. In recent years, certain exercise machines which utilize movable carriages have been increasing in popularity. However, the choices of exercise movements to be performed on a single exercise machine with a single carriage are limited. Such exercise machines may limit an exerciser to only movements that utilize the feet or the hands, but not both. By utilizing a pair of exercise machines in concert with each other, a wide range of exercise movements that were not previously available to be performed may be utilized by an exerciser as desired.

SUMMARY

An example embodiment is directed to a system and method of using two exercise machines. The system and method of using two exercise machines includes a first exercise machine and a second exercise machine which are used in concert to perform a wide range of exercise movements. The first exercise machine may include a track, a carriage movably connected to the track, and an end platform. The second exercise machine may include its own separate track, a carriage movably connected to the track, and an end platform. The exercise machines may be positioned side-to-side in parallel orientation such that an exerciser may perform various exercise moves by positioning different limbs on the respective carriages, end platforms, and/or tracks of the exercise machines, in addition to the surface underlying the exercise machines.

There has thus been outlined, rather broadly, some of the embodiments of the system and method of using two exercise machines in order that the detailed description thereof may be better understood, and in order that the present contribution to the art may be better appreciated. There are additional embodiments of the system and method of using two exercise machines that will be described hereinafter and that will form the subject matter of the claims appended hereto. In this respect, before explaining at least one embodiment of the system and method of using two exercise machines in detail, it is to be understood that the system and method of using two exercise machines is not limited in its application to the details of construction or to the arrangements of the components set forth in the following description or illustrated in the drawings. The system and method of using two exercise machines is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
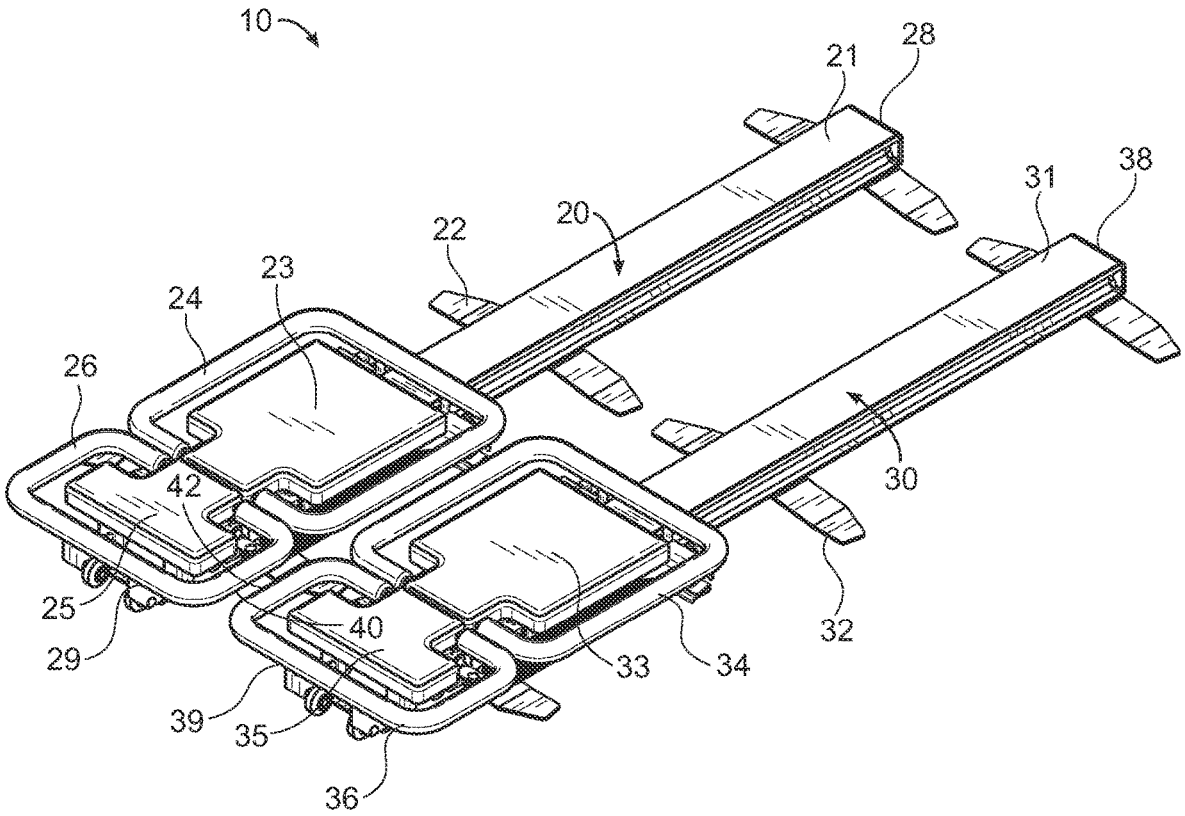
FIG. 1 is a perspective view of a pair of exercise machines in accordance with an example embodiment.

A. Overview.

An example system and method of using two exercise machines 10 generally comprises a first exercise machine 20 and a second exercise machine 30, the first exercise machine 20 comprising a first track 21, a first end platform 25 directly or indirectly connected to the first track 21, a first carriage 23 movably connected to the first track 21, a first end 28, a second end 29, and a first longitudinal axis 50 extending therebetween and the second exercise machine 30 comprising a second track 31, a second end platform 35 directly or indirectly connected to the second track 31, a second carriage 33 movably connected to the second track 31, a first end 38, a second end 39, and a second longitudinal axis 52 extend therebetween, comprising the steps of positioning the first exercise machine 20 near the second exercise machine 30 such that the first longitudinal axis 50 of the first exercise machine 20 is parallel with the second longitudinal axis 52 of the second exercise machine 30, wherein an inner edge 40 of the first exercise machine 20 is near an inner edge 42 of the second exercise machine 30; positioning a first limb 13*a*, 13*b*, 14*a*, 14*b*, 15*a*, 15*b*, 16*a*, 16*b* of an exerciser 12 on the first carriage 23 of the first exercise machine 20; positioning a second limb 13*a*, 13*b*, 14*a*, 14*b*, 15*a*, 15*b*, 16*a*, 16*b* of the exerciser 12 on the second carriage 33 of the second exercise machine 30; moving the first carriage 23 along at least a portion of the first track 21 of the first exercise machine 20 with the first limb 13*a*, 13*b*, 14*a*, 14*b*, 15*a*, 15*b*, 16*a*, 16*b* by the exerciser 12; and moving the second carriage 33 of the second exercise machine 30 along at least a portion of the second track 31 with the second limb 13*a*, 13*b*, 14*a*, 14*b*, 15*a*, 15*b*, 16*a*, 16*b* by the exerciser 12, wherein the first carriage 23 of the first exercise machine 20 moves independently with respect to the second carriage 33 of the second exercise machine 30.

The first exercise machine 20 may be connected or not be connected to the second exercise machine 30. The first end 28 and the second end 29 of the first exercise machine 20 and the first end 38 and the second end 39 of the second exercise machine 30 are on a common plane that is tangential to the first longitudinal axis 50 and the second longitudinal axis 52. The first end 28 of the first exercise machine 20 is near the first end 38 of the second exercise machine 30 and the second end 29 of the first exercise machine 20 is near the second end 39 of the second exercise machine 30. The first end platform 25 of the first exercise machine 20 is near the second end platform 35 of the second exercise machine 30. The first exercise machine 20 may be in contact or not in contact with the second exercise machine 30. The first limb 13*a*, 13*b*, 14*a*, 14*b*, 15*a*, 15*b*, 16*a*, 16*b* may be comprised of a first hand 13*a* of the exerciser 12 and the second limb 13*a*, 13*b*, 14*a*, 14*b*, 15*a*, 15*b*, 16*a*, 16*b* may be comprised of a second hand 13*b* of the exerciser 12. The first foot 16*a* and the second foot 16*b* may be positioned on a surface 11 underlying the exercise machines 20, 30 by the exerciser 12.

The first limb 13*a*, 13*b*, 14*a*, 14*b*, 15*a*, 15*b*, 16*a*, 16*b* may be comprised of a first forearm 14*a* of the exerciser 12 and the second limb 13*a*, 13*b*, 14*a*, 14*b*, 15*a*, 15*b*, 16*a*, 16*b* may be comprised of a second forearm 14*b* of the exerciser 12. The first limb 13*a*, 13*b*, 14*a*, 14*b*, 15*a*, 15*b*, 16*a*, 16*b* may be comprised of a first foot 16*a* of the exerciser 12 and the second limb 13*a*, 13*b*, 14*a*, 14*b*, 15*a*, 15*b*, 16*a*, 16*b* may be comprised of a second foot 16*b* of the exerciser 12. The first hand 13*a* and the second hand 13*b* of the exerciser 12 may be positioned on a surface 11 underlying the first and second exercise machines 20, 30 by the exerciser 12.

The first hand 13*a* may be positioned on the first end platform 25 of the first exercise machine 20 and the second hand 13*b* may be positioned on the second end platform 35 of the second exercise machine 30 by the exerciser 12. The first foot 16*a* of the exerciser 12 may be positioned on the first carriage handle 24 of the first carriage 23 of the first exercise machine 20 and the second foot 16*b* of the exerciser 12 may be positioned on the second carriage handle 34 of the second carriage 33 of the second exercise machine 30. The first limb 13*a*, 13*b*, 14*a*, 14*b*, 15*a*, 15*b*, 16*a*, 16*b* may be comprised of a first shin of the exerciser 12 and the second limb 13*a*, 13*b*, 14*a*, 14*b*, 15*a*, 15*b*, 16*a*, 16*b* may be comprised of a second shin of the exerciser 12. The exerciser 12 may position a first hand 13*a* on the first track 21 of the first exercise machine 20 and a second hand 13*b* on the second track 31 of the second exercise machine 30 by the exerciser 12.

The first limb 13*a*, 13*b*, 14*a*, 14*b*, 15*a*, 15*b*, 16*a*, 16*b* may be comprised of a first knee of the exerciser 12 and the second limb 13*a*, 13*b*, 14*a*, 14*b*, 15*a*, 15*b*, 16*a*, 16*b* may be comprised of a first hand 13*a* of the exerciser 12. The exerciser 12 may position a second knee on the first carriage 23 of the first exercise machine 20 and may position a second hand 13*b* on the second carriage 33 of the second exercise machine 30 by the exerciser 12. Alternatively, the exerciser 12 may position a second knee on the first end platform 25 of the first exercise machine 20 and a second hand 13*b* on the second end platform 35 of the second exercise machine 30.

In an alternate embodiment, the first limb 13*a*, 13*b*, 14*a*, 14*b*, 15*a*, 15*b*, 16*a*, 16*b* may be comprised of a first foot 16*a* of the exerciser 12 and the second limb 13*a*, 13*b*, 14*a*, 14*b*, 15*a*, 15*b*, 16*a*, 16*b* may be comprised of a first hand 13*a* of the exerciser 12, with the second foot 16*b* of the exerciser 12 positioned on the first end platform 25 of the first exercise machine 20 and the second hand 13*b* of the exerciser 12 positioned on the second end platform 35 of the second exercise machine 30.

B. Exercise Machines.

As shown throughout the figures, the methods and systems described herein utilize a pair of exercise machines 20, 30 which are positioned side-to-side on an underlying surface 11 such as a floor, mat, the ground, or the like. The positioning and orientation of the exercise machines 20, 30 may vary in different embodiments. Thus, the exemplary positioning and orientation of the exercise machines 20, 30 shown in the figures should not be construed as limiting.

In the exemplary embodiments shown in the figures, the pair of exercise machines 20, 30 are positioned parallel to each other, with the first end 28 of the first exercise machine 20 being positioned adjacent to or near the first end 38 of the second exercise machine 30, and the second end 29 of the first exercise machine 20 being positioned adjacent to or near the second end 39 of the second exercise machine 30. In alternate embodiments, an opposite orientation may be utilized, with the first end 28 of the first exercise machine 20 being positioned adjacent to or near the second end 39 of the second exercise machine 30, and the second end 29 of the first exercise machine 20 being positioned adjacent to or near the first end 38 of the second exercise machine 30.

Figure 2:
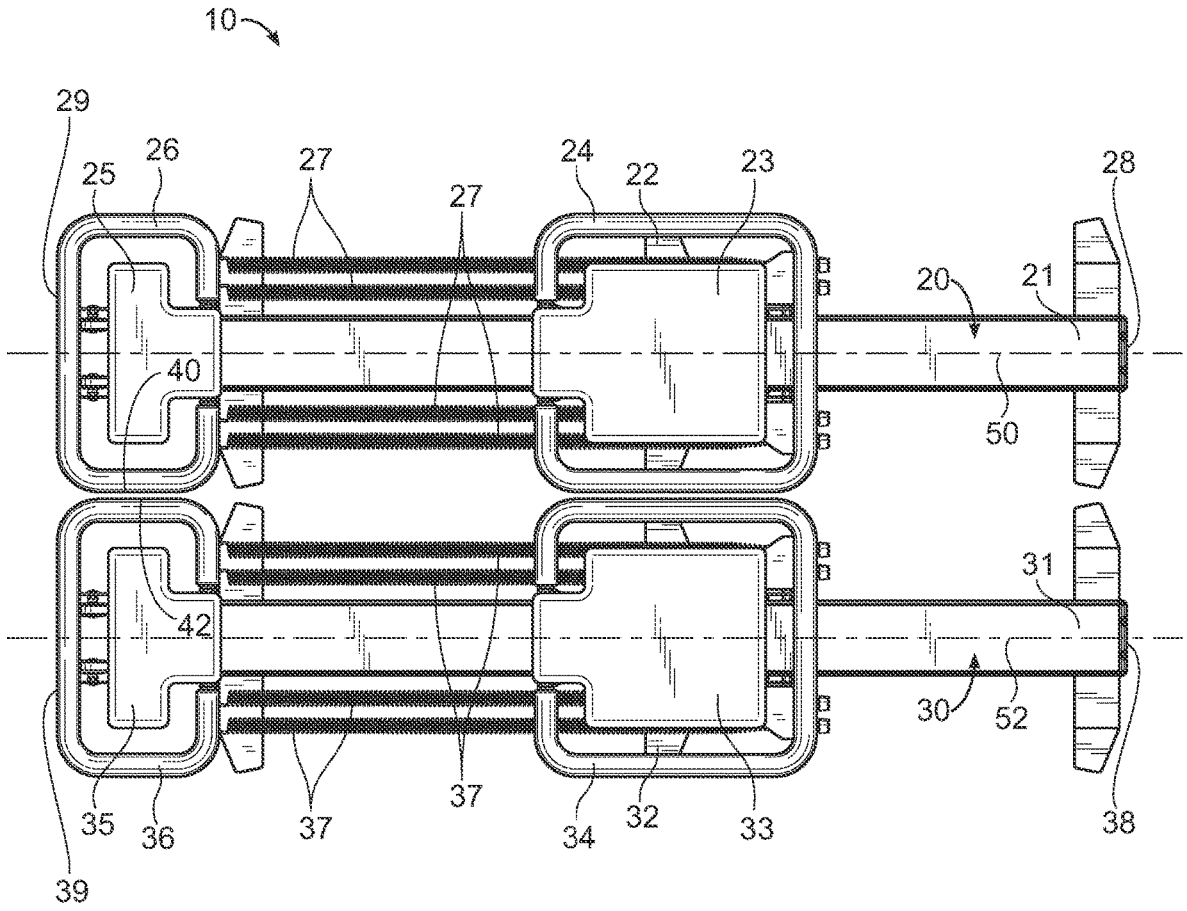
FIG. 2 is a top view of a pair of exercise machines in accordance with an example embodiment.

As shown in FIG. 2, a first longitudinal axis 50 may extend between the first and second ends 28, 29 of the first exercise machine 20 along the first track 21. Similarly, a second longitudinal axis 52 may extend between the first and second ends 38, 39 of the second exercise machine 30 along the second track 31. In exemplary embodiments such as shown in the figures, the first end 28 and the second end 29 of the first exercise machine 20, and the first end 38 and the second end 39 of the second exercise machine 30, may be on a common plane that is tangential with respect to the first longitudinal axis 50 of the first exercise machine 20 and the second longitudinal axis 52 of the second exercise machine 30.

The angle between the first and second exercise machines 20, 30 may vary in different embodiments. In the exemplary figures, an exemplary embodiment is illustrated in which the first exercise machine 20 is parallel with respect to the second exercise machine 30. Put differently, the first longitudinal axis 50 of the first exercise machine 20 may be parallel with respect to the second longitudinal axis 52 of the second exercise machine 30.

It should be appreciated that other orientations may be utilized. For example, the first and second exercise machines 20, 30 may be angled towards each other, or angled away from each other, in different embodiments depending on the needs of the exerciser 12 and/or the exercise moves being performed.

The distance between the pair of exercise machines 20, 30 may vary in different embodiments. Generally, they will be positioned next to each other (e.g., adjacent to or near each other), but not in contact, such as shown in the figures. In some embodiments, the pair of exercise machines 20, 30 may contact each other when positioned and oriented for use.

In other embodiments, the exercise machines 20, 30 may be distally-spaced with respect to each other such that the inner edge 50 of the first exercise machine 20 is not in contact with the inner edge 52 of the second exercise machine 30. In such embodiments, the distance between the exercise machines 20, 30 may vary depending on the particular exerciser 12. FIG. 14C illustrates that the exercise machines 20, 30 have been separated by a distance D1. The distance D1 between the respective inner edges 50, 52 of the exercise machines 20, 30 may vary in different embodiments as discussed herein. By way of example and without limitation, the distance D1 could range from 0.5 inches to 5 feet, depending on the exercises being performed and the physical characteristics of the exerciser 12.

Figure 8A:
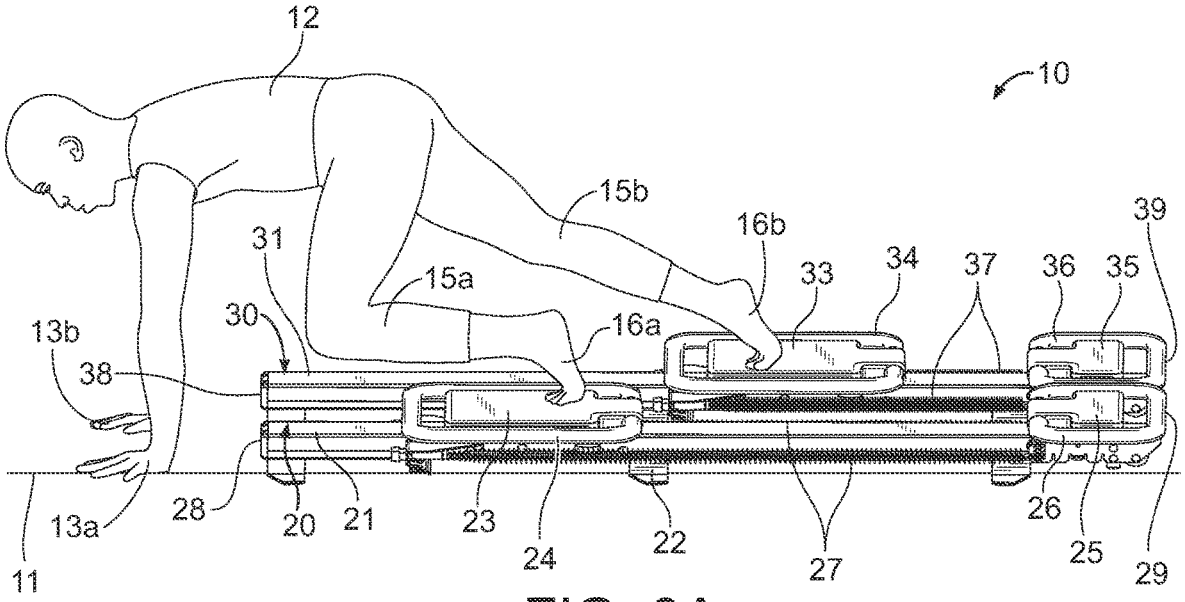
FIG. 8A is a side perspective view of an exerciser performing an exercise movement on the pair of exercise machines in accordance with an example embodiment.
Figure 8B:
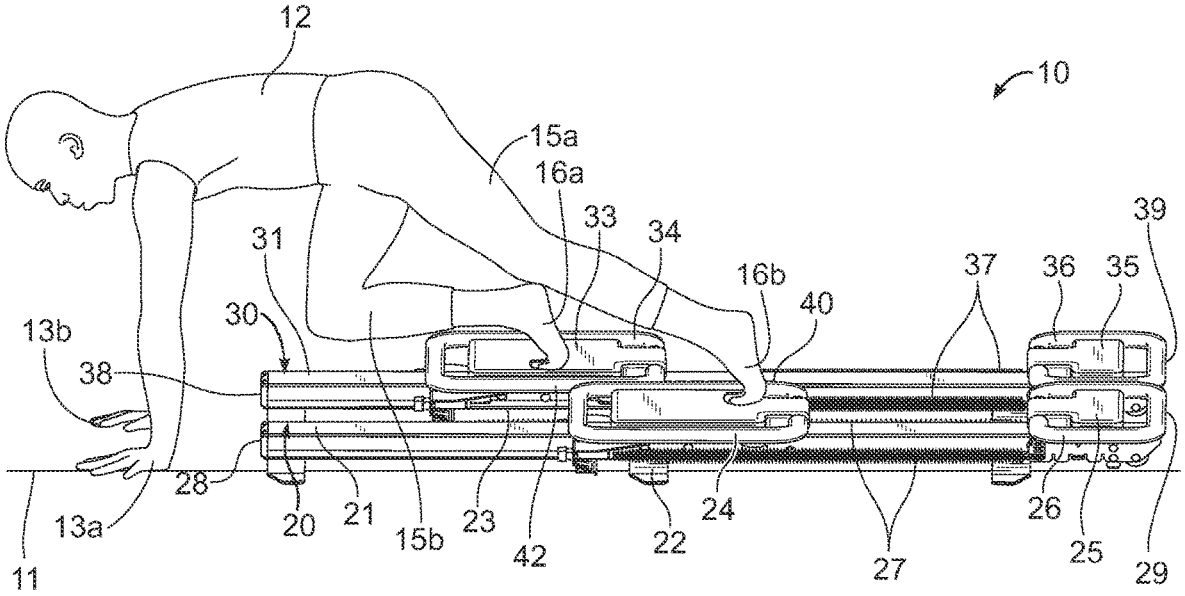
FIG. 8B is a side perspective view of an exerciser performing an exercise movement on the pair of exercise machines in accordance with an example embodiment.

For example, an exerciser 12 with longer legs will space the exercise machines 20, 30 further apart from each other than an exerciser 12 with shorter legs. Further, the distance D1 between the exercise machines 20, 30 may be adjusted for different exercise movements. For example, the exercise machines 20, 30 in FIGS. 8A and 8B are illustrated as being closer together than the exercise machines 20, 30 in FIGS. 14A and 14B due to the different exercise movements being performed in those respective figures.

The exercise machines 20, 30 in the exemplary figures are shown as being disconnected from each other, with the first exercise machine 20 not being in contact or connected in any way to the second exercise machine 30. However, in some embodiments, it may be desirable to connect the two exercise machines 20, 30 to each other so as to, for example, ensure that the orientation and positioning of the respective exercise machines 20, 30 is not disrupted during particularly intense exercises. In such embodiments, the first exercise machine 20 may be connected to the second exercise machine 30, such as by a frame.

The figures illustrate an exemplary embodiment of the first and second exercise machines 20, 30. It should be appreciated that different types of exercise machines 20, 30 may be utilized, and thus the scope should not be construed as limited to the particular design of exercise machines 20, 30 shown in the figures.

By way of a non-limiting example, one or both of the exercise machines 20, 30 may be comprised of the exercise machine shown and described in U.S. Pat. No. 10,300,328, issued on May 28, 2019 and covering a "Tilting Exercise Machine", which is hereby incorporated by reference.

By way of another non-limiting example, one or both of the exercise machines 20, may be comprised of the exercise machine shown and described in U.S. Pat. No. 9,962,592, issued on May 8, 2018 and covering an "Exercise Machine Rail System", which is hereby incorporated by reference.

By way of another non-limiting example, one or both of the exercise machines 20, may be comprised of the exercise machine shown and described in U.S. Pat. No. 9,579,555, issued on Feb. 28, 2017 and covering an "Exercise Machine Rail System", which is hereby incorporated by reference.

By way of another non-limiting example, one or both of the exercise machines 20, may be comprised of the exercise machine shown and described in U.S. Pat. No. 8,641,585, issued on Feb. 4, 2014 and covering an "Exercise Machine", which is hereby incorporated by reference.

By way of another non-limiting example, one or both of the exercise machines 20, may be comprised of the exercise machine shown and described in U.S. Pat. No. 7,803,095, issued on Sep. 28, 2010 and covering an "Exercise Machine", which is hereby incorporated by reference.

In the exemplary embodiment best shown in FIGS. 1-5, the first and second exercise machines 20, 30 each share the same design and configuration. However, it should be appreciated that, in some embodiments, each of the exercise machines 20, 30 may have its own, distinct design or configuration. For example, the first exercise machine 20 may differ structurally from the second exercise machine 30. Thus, the scope should not be construed as limited to a pair of exercise machines 20, 30 which are mirror images of each other such as shown in the exemplary figures for illustrative purposes.

FIGS. 1-5 illustrate exemplary embodiments of exercise machines 20, 30 for use with the systems and methods described herein. The first exercise machine 20 will generally comprise a first track 21 and a first carriage 23 movably connected to the first track 21. One or more first bias members 27 may be removably connected between the first carriage 23 and various structures of the first exercise machine 20, such as but not limited to a frame, base, or track 21 of the first exercise machine 20. The first track 21 is illustrated as comprising a monorail design, but in different embodiments, the first track 21 may comprise parallel rails. The manner in which the first carriage 23 is movably connected to the first track 21 may vary in different embodiments, including but not limited to the use of carriage wheels.

Continuing to reference FIGS. 1-5, the first exercise machine 20 will generally comprise a plurality of base supports 22 such as feet or legs on which the first exercise machine 20 rests on the surface 11 underlying the first exercise machine 20, such as the floor, a mat, or a ground surface. The first carriage 23 may include a first carriage handle 24. Although the figures illustrate a single first carriage handle 24 which extends around the first carriage 23, it should be appreciated that additional handles 24 may be included in different embodiments and that the configuration of the first carriage handle 24 may vary (e.g., the first carriage handle 24 may not extend around the first carriage 23, but instead extend upwardly or outwardly therefrom).

The first exercise machine 20 may include a first end platform 25 which is positioned at the first end 28 or the second end 29 of the first exercise machine 20. In the exemplary figures, a single first end platform 25 is shown at the second end 29 of the first exercise machine 20. It should be appreciated that, in some embodiments, both ends 28, 29 of the first exercise machine 20 may include such an end platform 25. The first end platform 25 may include a first end platform handle 26. In the exemplary embodiment shown in the figures, the first end platform handle 26 is shown as extending around the first end platform 25. It should be appreciated that additional end platform handles 26 may be included in different embodiments and that the configuration of the first end platform handle 26 may vary (e.g., the first end platform handle 26 may not extend around the first end platform 25, but instead extend outwardly or upwardly therefrom).

The second exercise machine 30 will generally comprise a second track 31 and a second carriage 33 movably connected to the second track 31. One or more second bias members 37 may be removably connected between the second carriage 33 and various structures of the second exercise machine 30, such as but not limited to a frame, base, or track 31 of the second exercise machine 30. The second track 31 is illustrated as comprising a monorail design, but in different embodiments, the second track 31 may comprise parallel rails. The manner in which the second carriage 33 is movably connected to the second track 31 may vary in different embodiments, including but not limited to the use of carriage wheels.

Continuing to reference FIGS. 1-5, the second exercise machine 30 will generally comprise a plurality of second base supports 32 such as feet or legs on which the second exercise machine 30 rests on the surface 11 underlying the second exercise machine 30, such as the floor, a mat, or a ground surface. The second carriage 33 may include a second carriage handle 34. Although the figures illustrate a single second carriage handle 34 which extends around the second carriage 33, it should be appreciated that additional handles 34 may be included in different embodiments and that the configuration of the second carriage handle 34 may vary (e.g., the second carriage handle 34 may not extend around the second carriage 33, but instead extend upwardly or outwardly therefrom).

The second exercise machine 30 may include a second end platform 35 which is positioned at the first end 38 or the second end 39 of the second exercise machine 30. In the exemplary figures, a single second end platform 35 is shown at the second end 39 of the second exercise machine 30. It should be appreciated that, in some embodiments, both ends 38, 39 of the second exercise machine 30 may include such an end platform 35.

The second end platform 35 may include a second end platform handle 36. In the exemplary embodiment shown in the figures, the second end platform handle 36 is shown as extending around the second end platform 35. It should be appreciated that additional end platform handles 36 may be included in different embodiments and that the configuration of the second end platform handle 2366 may vary (e.g., the second end platform handle 36 may not extend around the second end platform 35, but instead extend outwardly or upwardly therefrom).

C. Operation of Preferred Embodiment.

The systems and methods described herein may be utilized to perform a wide range of exercises which rely upon a pair of exercise machines 20, 30 being used in concert. As shown and described herein, an exerciser 12 may utilize various limbs 13*a*, 13*b*, 14*a*, 14*b*, 15*a*, 15*b*, 16*a*, 16*b* positioned at various locations, such as on the carriages 23, 33, end platforms 25, 35, tracks 21, 31, and/or the surface 11 underlying the exercise machines 20, 30 to perform a wide range of exercise moves. While the below sections describe a variety of possible exercise movements to be performed using a pair of exercise machines 20, 30, it should be appreciated that various other exercise moves may be performed using the pair of exercise machines 20, 30.

In use, the exercise machines 20, 30 are first positioned near each other. The exercise machines 20, 30 may be positioned on various surfaces 11, such as not limited to a ground surface, a floor, a mat, or the like. The distance between the exercise machines 20, 30 may vary depending on the exerciser 12 as well as the exercise moves to be performed. The exercise machines 20, 30 may be adjacent to each other such that the exercise machines 20, 30 are in contact, or may be positioned adjacent to each other but not in direct contact.

The exercise machines 20, 30 may be parallel or may be oriented towards or away from each other. The exercise machines 20, 30 may be oriented the same, with the first end 28 of the first exercise machine 20 being near the first end 38 of the second exercise machine 30, or the exercise machines 20, 30 may be alternatively oriented, such as with the first end 28 of the first exercise machine 20 being near the second end 39 of the second exercise machine 30.

With the exercise machines 20, 30 positioned and oriented as desired by the exerciser 12 for performance of exercise moves, the exerciser 12 may begin performing exercises. It should be appreciated that the exercise machines 20, 30 themselves may be easily moved between exercises as needed. For example, it may be desirable to perform a first exercise move in which the exercise machines 20, 30 are adjacent to each other and then move the exercise machines 20, 30 apart from each other to perform additional exercise movements. As a further example, it may be desirable to perform a first exercise move in which the exercise machines 20, 30 are parallel to each other and then move the exercise machines 20, 30 angularly to a different orientation with respect to each other.

Figure 3:
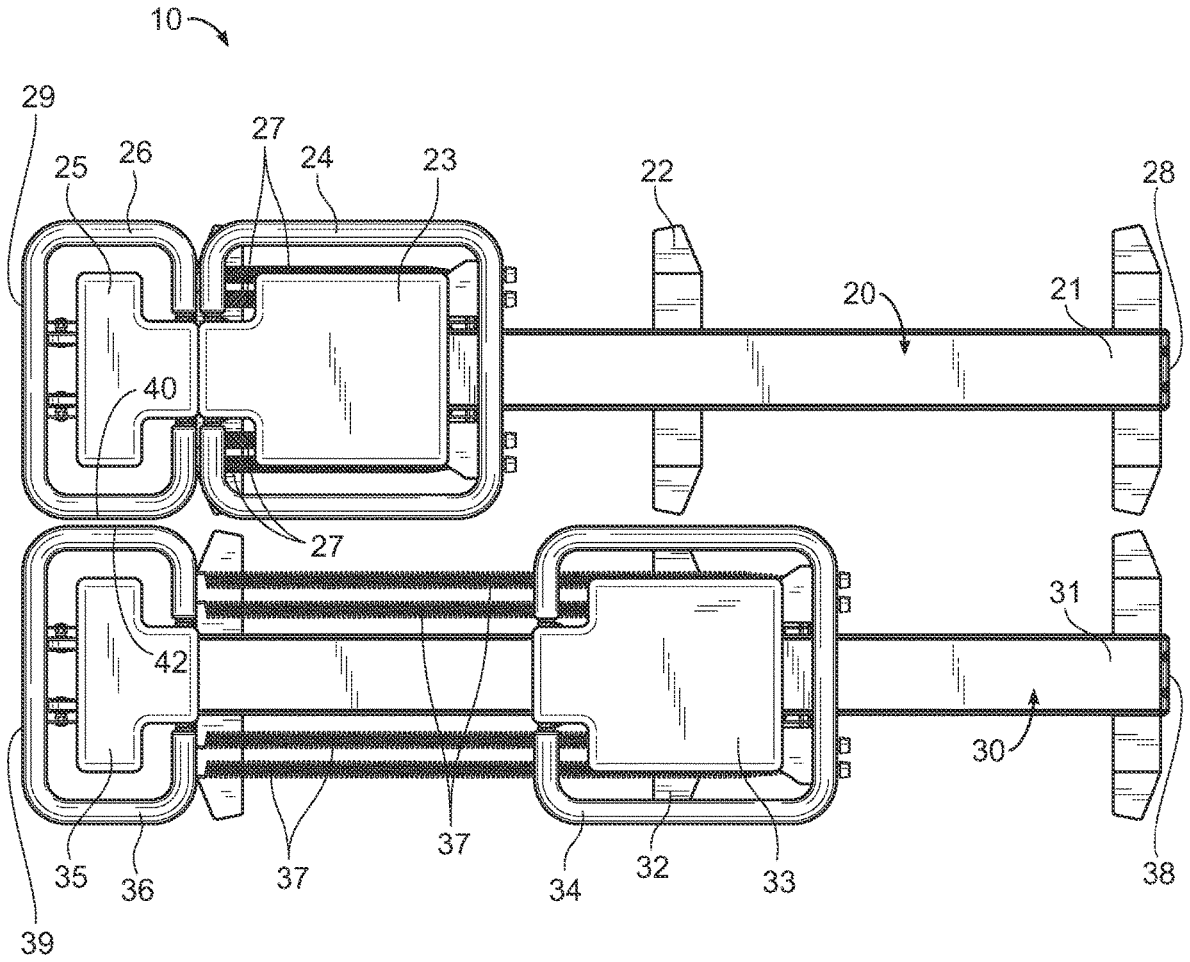
FIG. 3 is a top view of a pair of exercise machines with the first carriage moved in accordance with an example embodiment.
Figure 4:
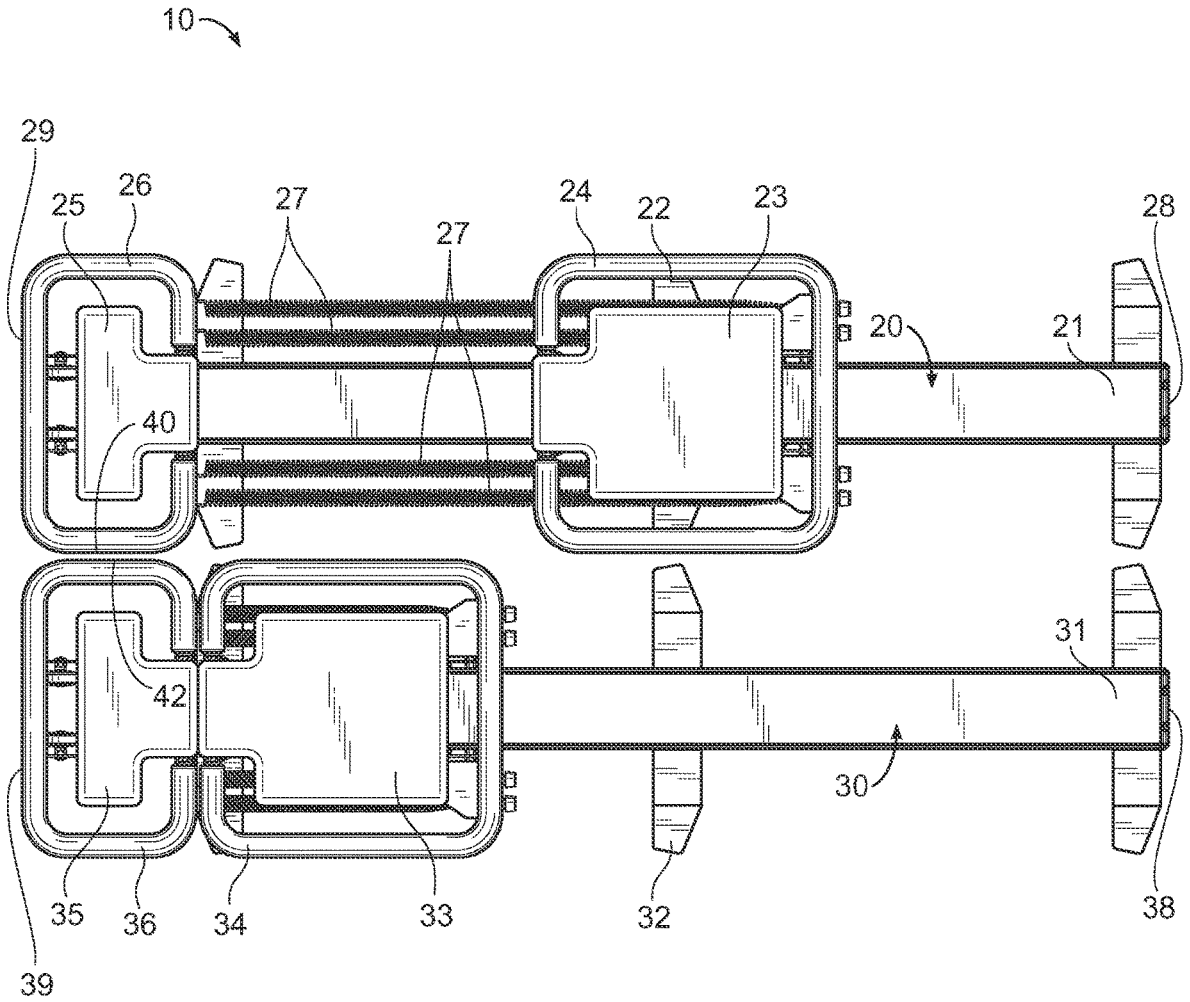
FIG. 4 is a top view of a pair of exercise machines with the second carriage moved in accordance with an example embodiment.
Figure 5:
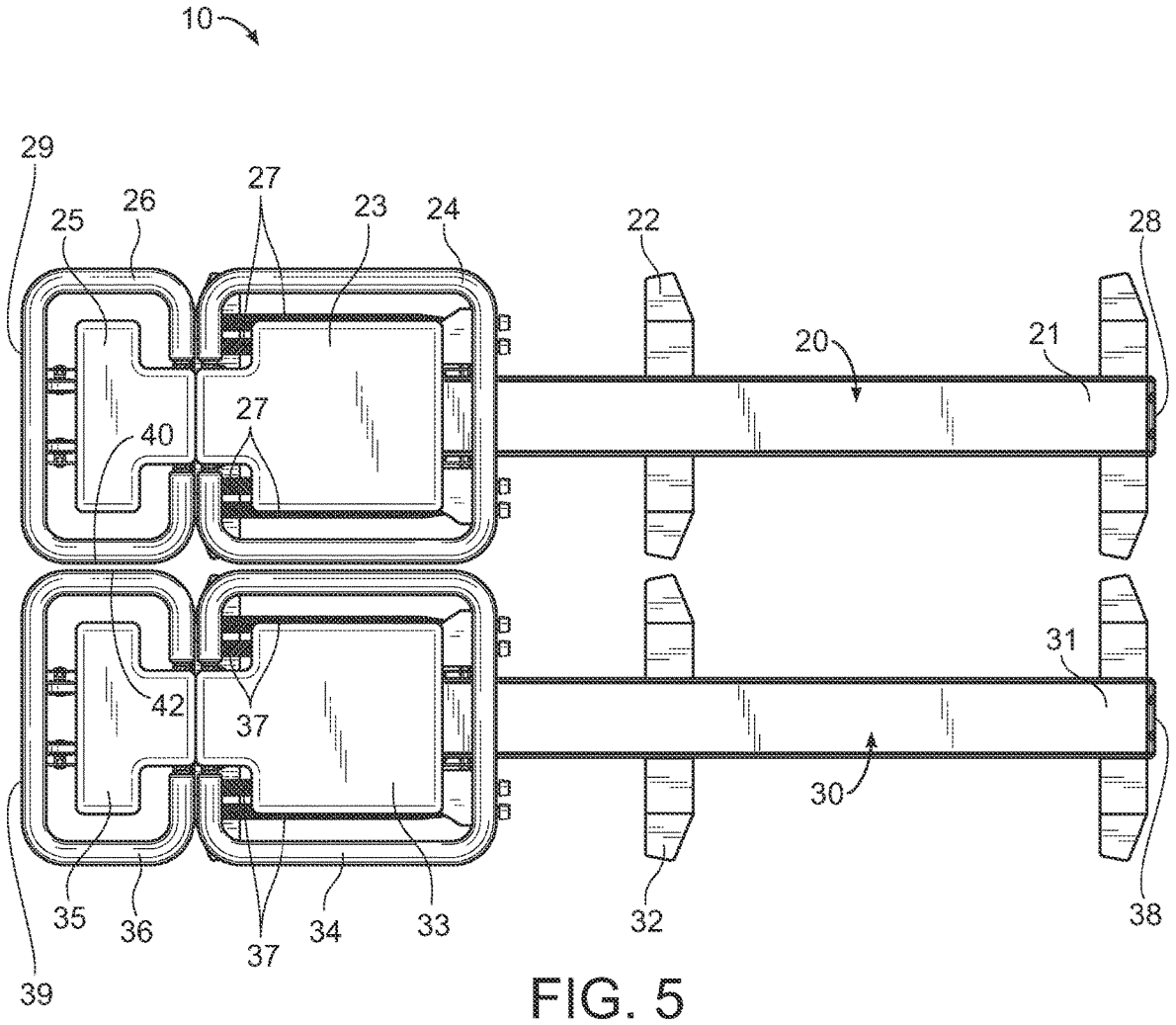
FIG. 5 is a top view of a pair of exercise machines with both carriages moved in accordance with an example embodiment.

FIGS. 2-5 illustrate different positioning of the carriages 23, 33 of the pair of exercise machines 20, 30. FIG. 2 illustrates that the two carriages 23, 33 are positioned side-by side with each other. FIG. 3 illustrates that the first carriage 23 of the first exercise machine 20 has been moved towards the first end platform 25. FIG. 4 illustrates that the second carriage 33 of the second exercise machine 30 has been moved towards the second end platform 35. FIG. 5 illustrates that the first carriage 23 of the first exercise machine 20 has been moved towards the first end platform 25 and the second carriage 33 of the second exercise machine 30 has been moved towards the second end platform 35.

Figure 6A:
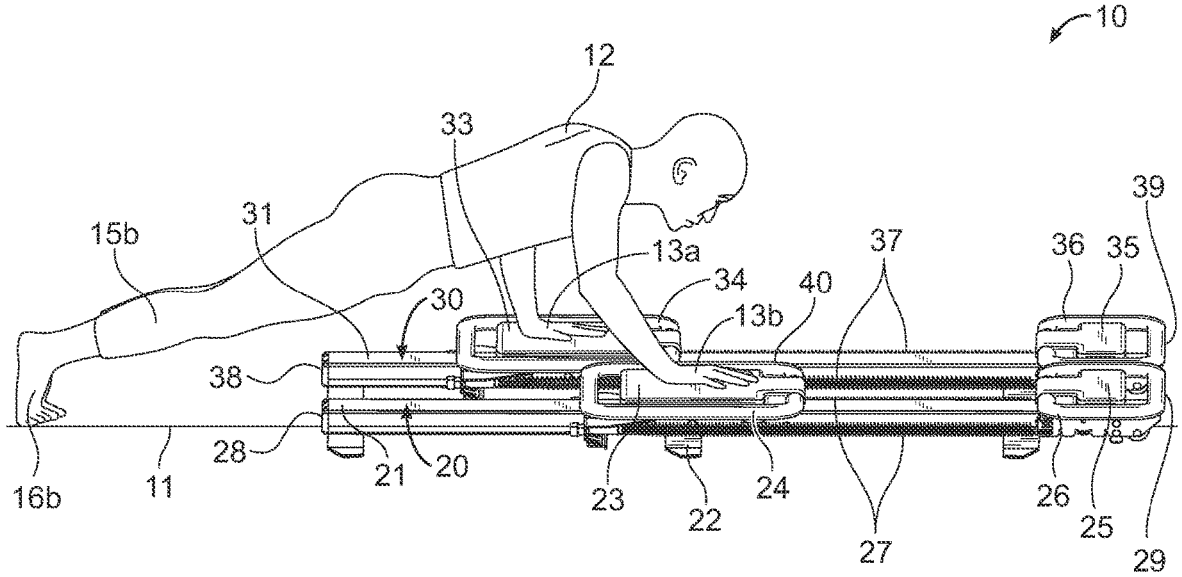
FIG. 6A is a side perspective view of an exerciser performing an exercise movement on the pair of exercise machines in accordance with an example embodiment.
Figure 6B:
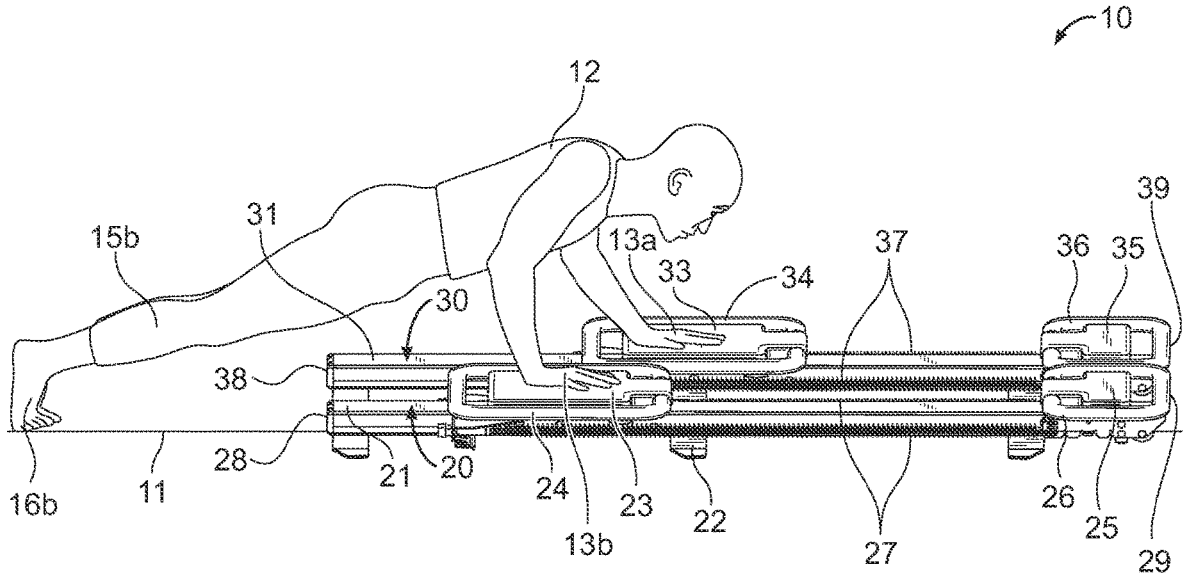
FIG. 6B is a side perspective view of an exerciser performing an exercise movement on the pair of exercise machines in accordance with an example embodiment.
Figure 15:
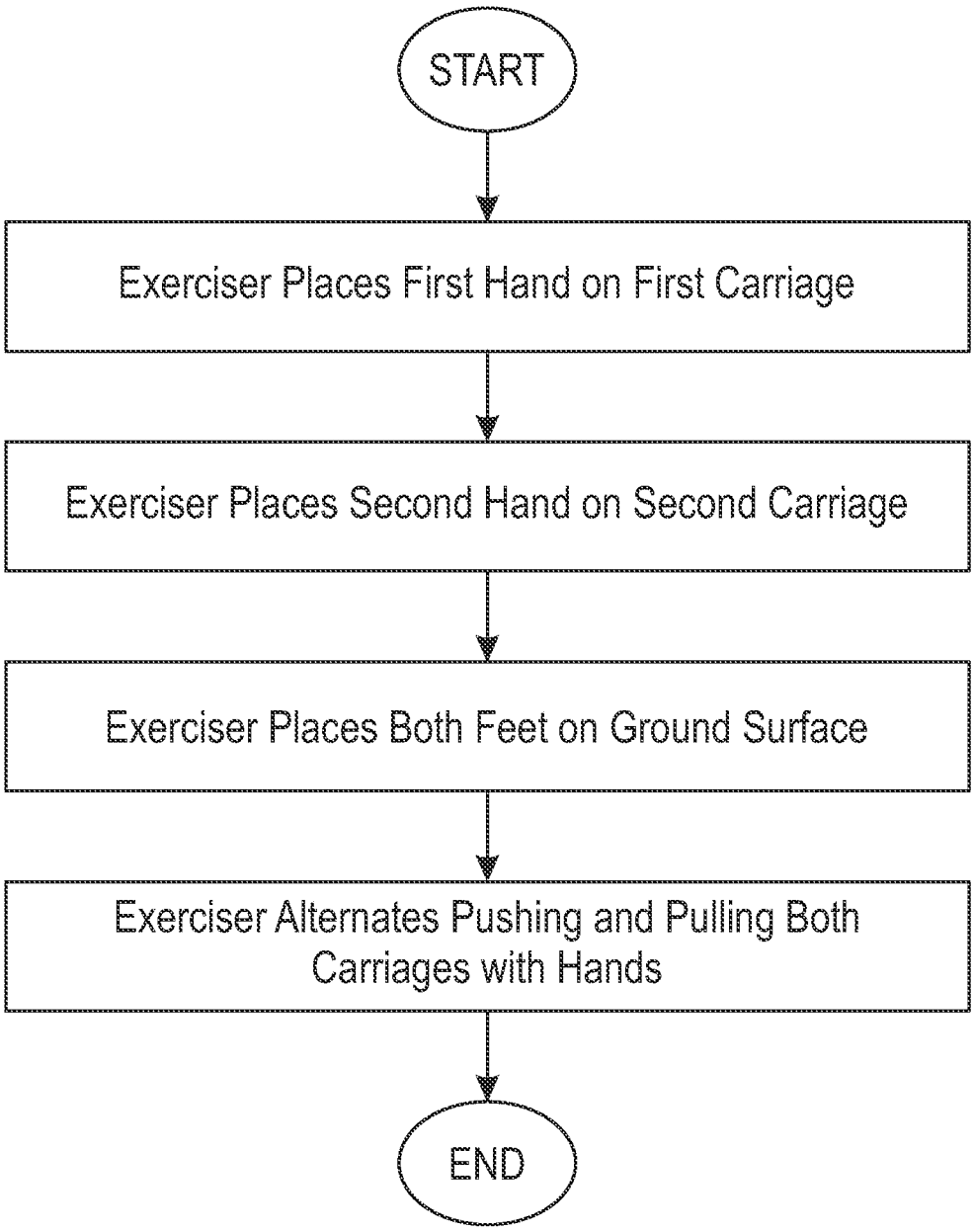
FIG. 15 is a flowchart illustrating an exemplary exercise movement to be performed on the pair of exercise machines in which the hands are on the carriages and the feet are on an underlying surface in accordance with an example embodiment.

FIGS. 6A, 6B, and 15 illustrate a first exemplary exercise movement that can be performed using the pair of exercise machines 20, 30. As can be seen, the pair of exercise machines 20, 30 have been positioned near each other in parallel orientation. The exerciser 12 positions a first hand 13*a* on the first carriage 23 of the first exercise machine 20 and a second hand 13*b* on the second carriage 33 of the second exercise machine 30.

With the hands 13*a*, 13*b* positioned on each of the carriages 23, 33, the exerciser 12 may position his/her feet 16*a*, 16*b* on the surface 11 underlying the exercise machines 20, 30. In the exemplary figures, it can be seen that the exerciser 12 has positioned his feet 16*a*, 16*b* together at a point that is past the respective first ends 28, 38 of the exercise machines 20, 30. The feet 16*a*, 16*b* may be positioned together such that the exerciser 12 is in a "push-up" configuration.

With the exerciser's 12 hands 13*a*, 13*b* on the carriages 23, 33 and feet 16*a*, 16*b* on the underlying surface 11, the exerciser 12 may begin exercise movements. The exerciser 12 may alternate between moving the first carriage 23 with his first hand 13*a* and moving the second carriage 33 with his second hand 13*b*. The carriages 23, 33 may be pushed and pulled along at least a portion of the tracks 21, 31 repeatedly to perform the exercise movements.

Bias members 27, 37 may be selectively connected to the carriages 23, 33 to adjust resistance to movement of the carriages 23, 33. In some embodiments, it may be beneficial to apply a first resistance level to the first carriage 23 and a second resistance level to the second carriage 33, which can be accomplished by connecting different numbers of bias members 27, 37 to each of the carriages 23, 33.

Figure 7A:
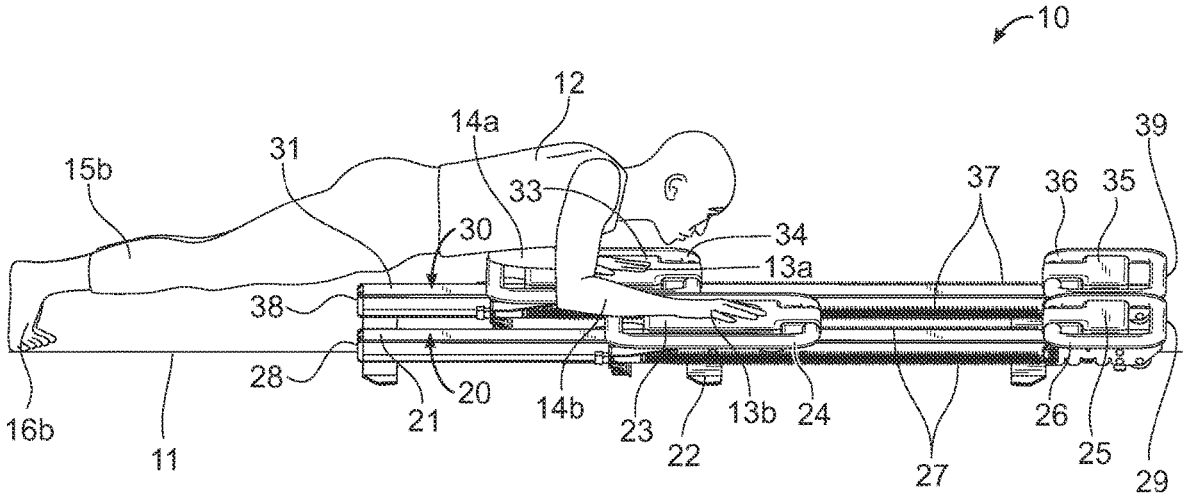
FIG. 7A is a side perspective view of an exerciser performing an exercise movement on the pair of exercise machines in accordance with an example embodiment.
Figure 7B:
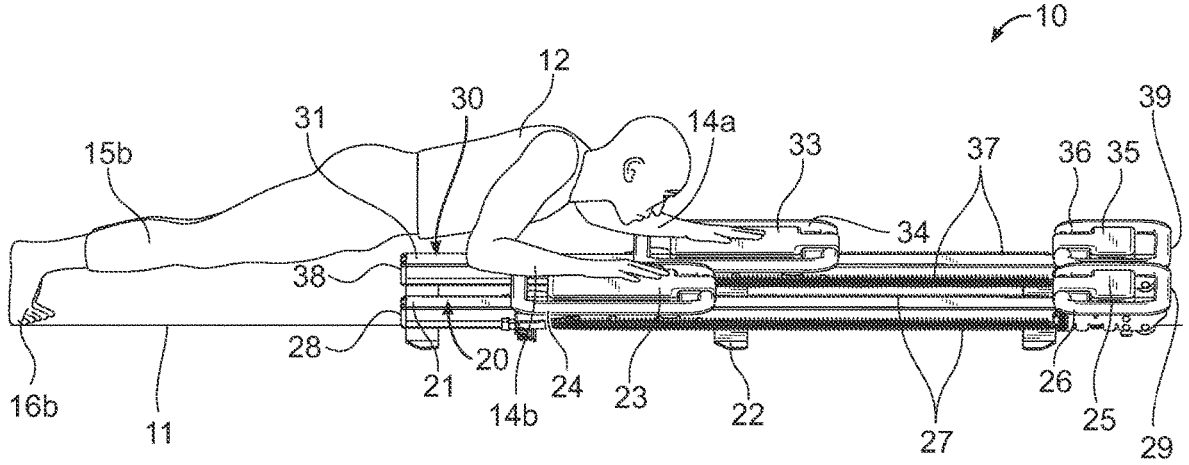
FIG. 7B is a side perspective view of an exerciser performing an exercise movement on the pair of exercise machines in accordance with an example embodiment.
Figure 16:
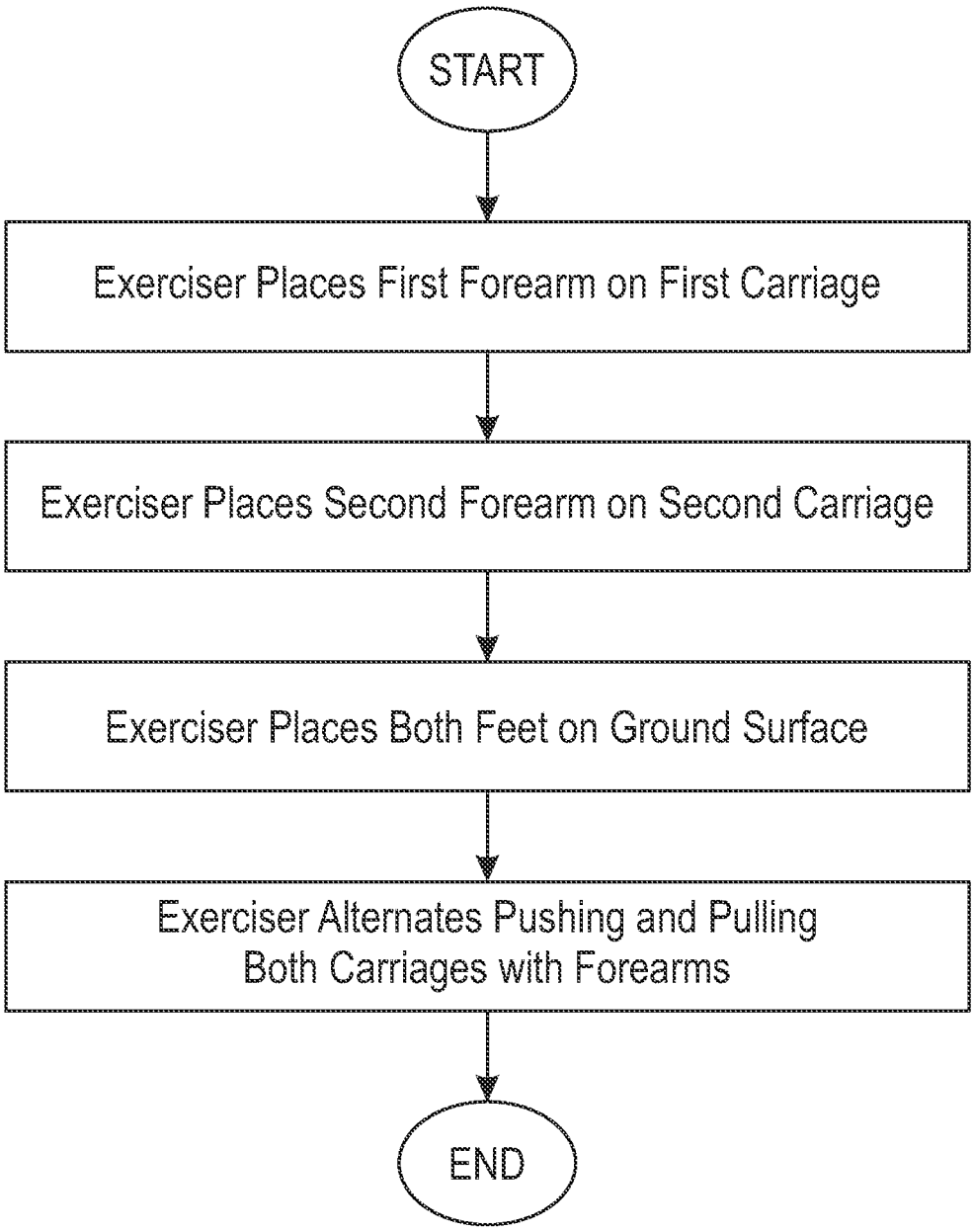
FIG. 16 is a flowchart illustrating another exemplary exercise movement to be performed on the pair of exercise machines in which the forearms are on the carriages and the feet are on an underlying surface in accordance with an example embodiment.

FIGS. 7A, 7B, and 16 illustrate an exerciser 12 performing a second exemplary exercise movement with the use of a pair of exercise machines 20, 30 positioned next to each other side-by-side. As can be seen, the exerciser 12 has rested his first forearm 14*a* on the first carriage 23 of the first exercise machine 20 and his second forearm 14*b* on the second carriage 33 of the second exercise machine 30. The hands 13*a*, 13*b* of the exerciser 12 may rest upon the carriages 23, 33 as shown or may grasp the carriage handles 24, 34.

The exerciser 12 is shown with his feet 16*a*, 16*b* positioned on the underlying surface 11 and positioned together so as to form a "push-up" configuration with his body. The exerciser 12 may then alternate between moving the first carriage 23 with his first forearm 14*a* and moving the second carriage 33 with his second forearm 14*b*. The carriages 23, 33 may be pushed and pulled along at least a portion of the tracks 21, 31 repeatedly to perform the exercise movements. As with the previous embodiment, different resistance levels may be applied to each carriage 23, 33 as needed by selectively connecting or disconnecting bias members 27, 37.

Figure 17:
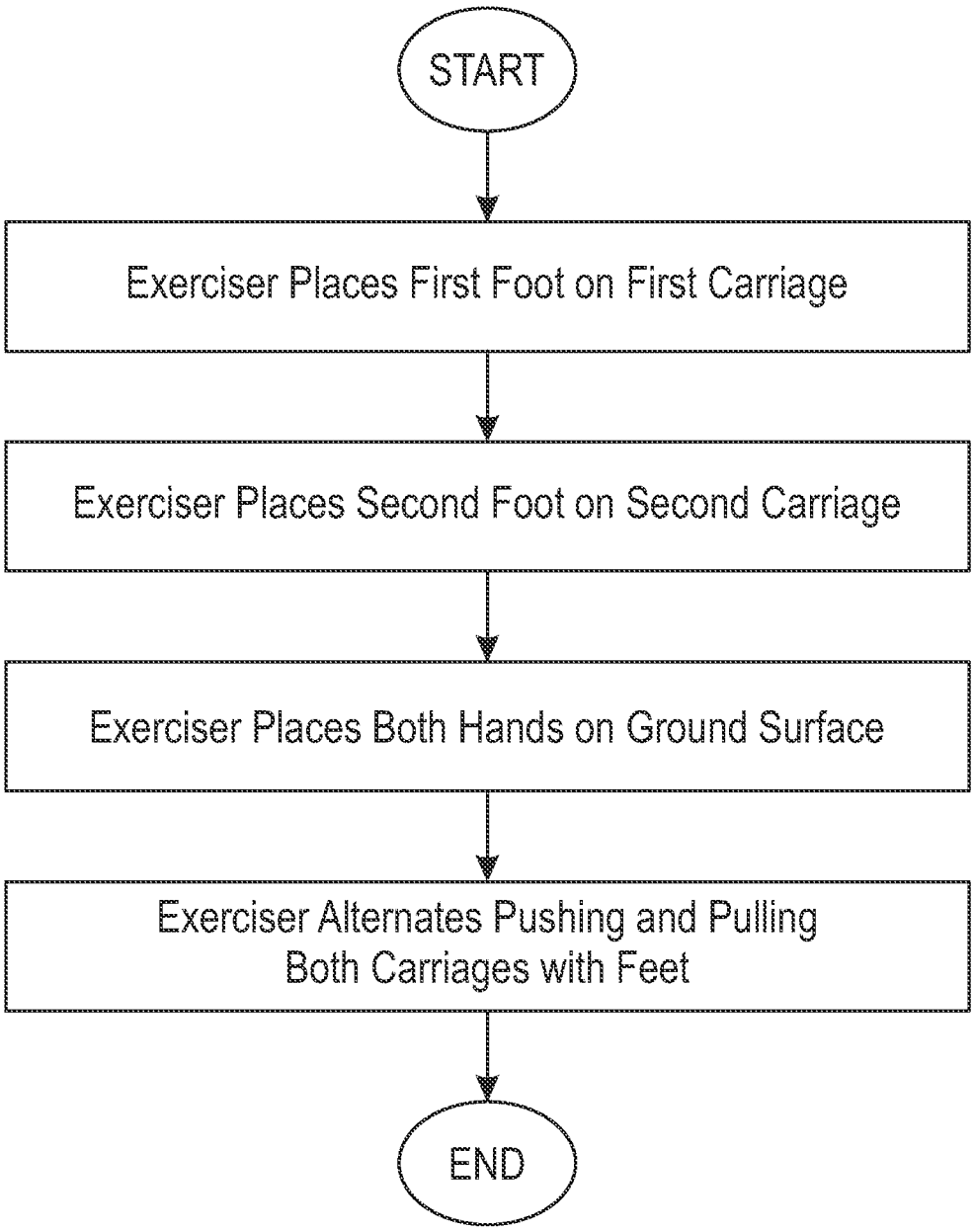
FIG. 17 is a flowchart illustrating another exemplary exercise movement to be performed on the pair of exercise machines in which the feet are on the carriages and the hands are on an underlying surface in accordance with an example embodiment.

FIGS. 8A, 8B, and 17 illustrate yet another exercise movement that can be performed on the pair of exercise machines 20, 30. As can be seen, the exerciser 12 has positioned his first foot 16*a* on the first carriage 23 of the first exercise machine 20 and his second foot 16*b* on the second carriage 33 of the second exercise machine 30. The hands 13*a*, 13*b* of the exerciser 12 are positioned on the underlying surface 11, slightly spaced-apart from each other.

In this position, the exerciser 12 may perform exercise moves. The exerciser 12 may alternate between moving the first carriage 23 with his first foot 16*a* and moving the second carriage 33 with his second foot 16*b*. The carriages 23, 33 may be pushed and pulled along at least a portion of the tracks 21, 31 with the exerciser's 12 feet 16*a*, 16*b* repeatedly to perform the exercise movements. As with previous embodiments, different resistance levels may be applied to each carriage 23, 33 as needed by selectively connecting or disconnecting bias members 27, 37.

Figure 9A:
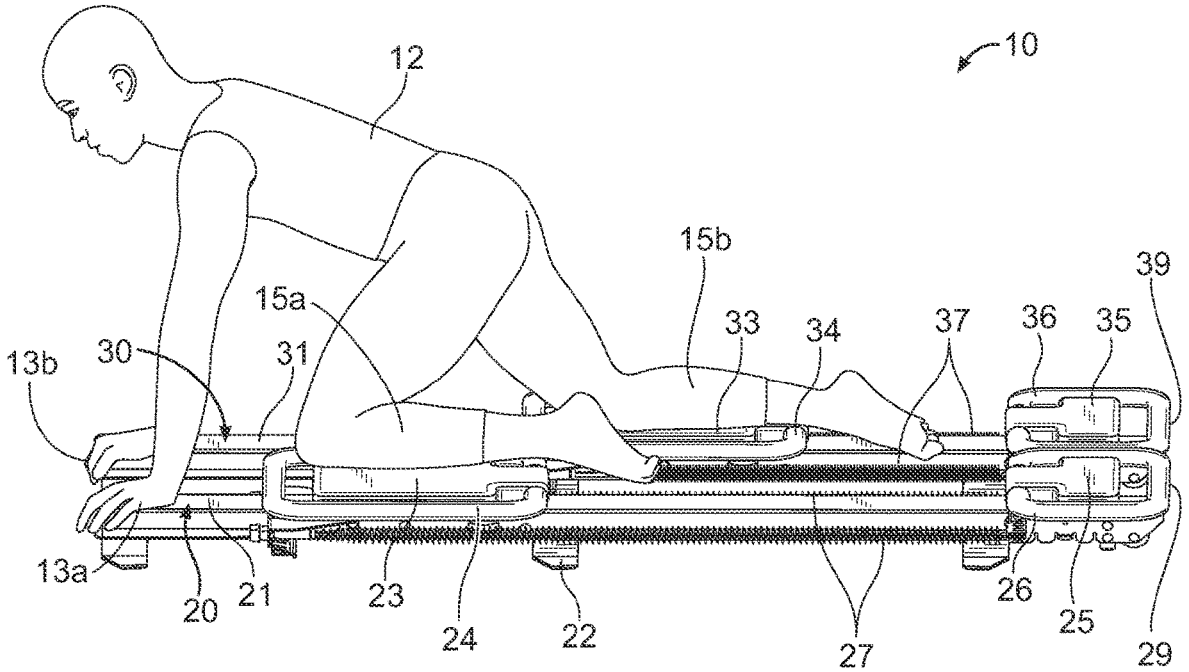
FIG. 9A is a side perspective view of an exerciser performing an exercise movement on the pair of exercise machines in accordance with an example embodiment.
Figure 9B:
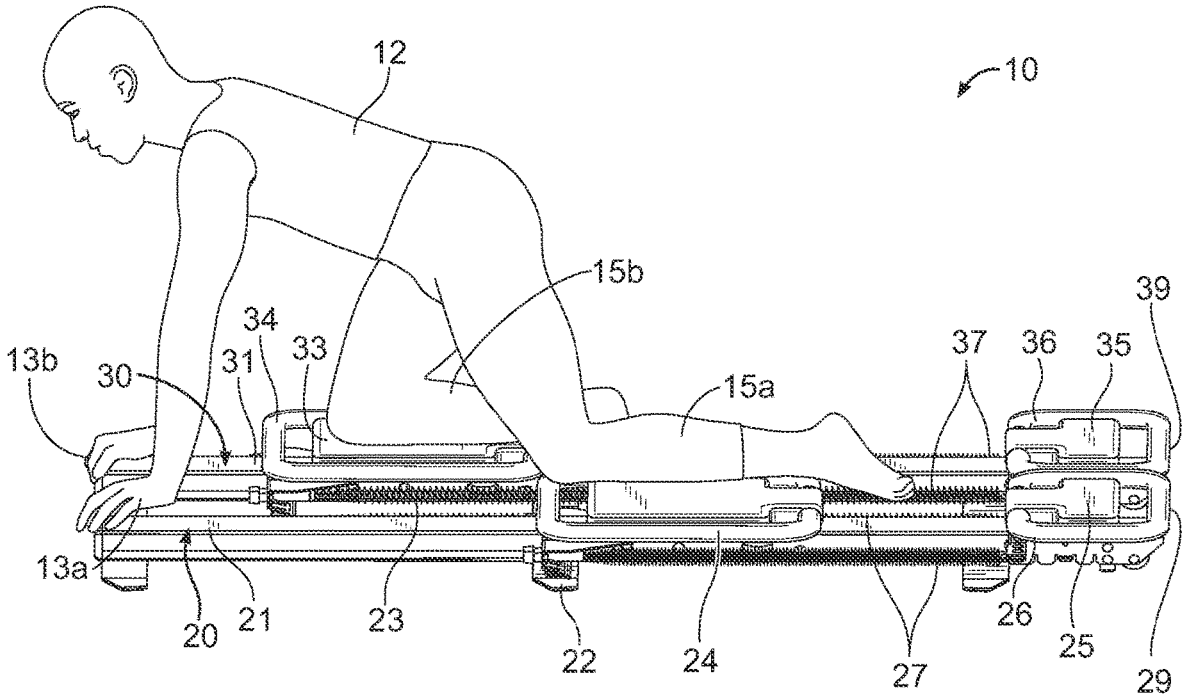
FIG. 9B is a side perspective view of an exerciser performing an exercise movement on the pair of exercise machines in accordance with an example embodiment.
Figure 18:
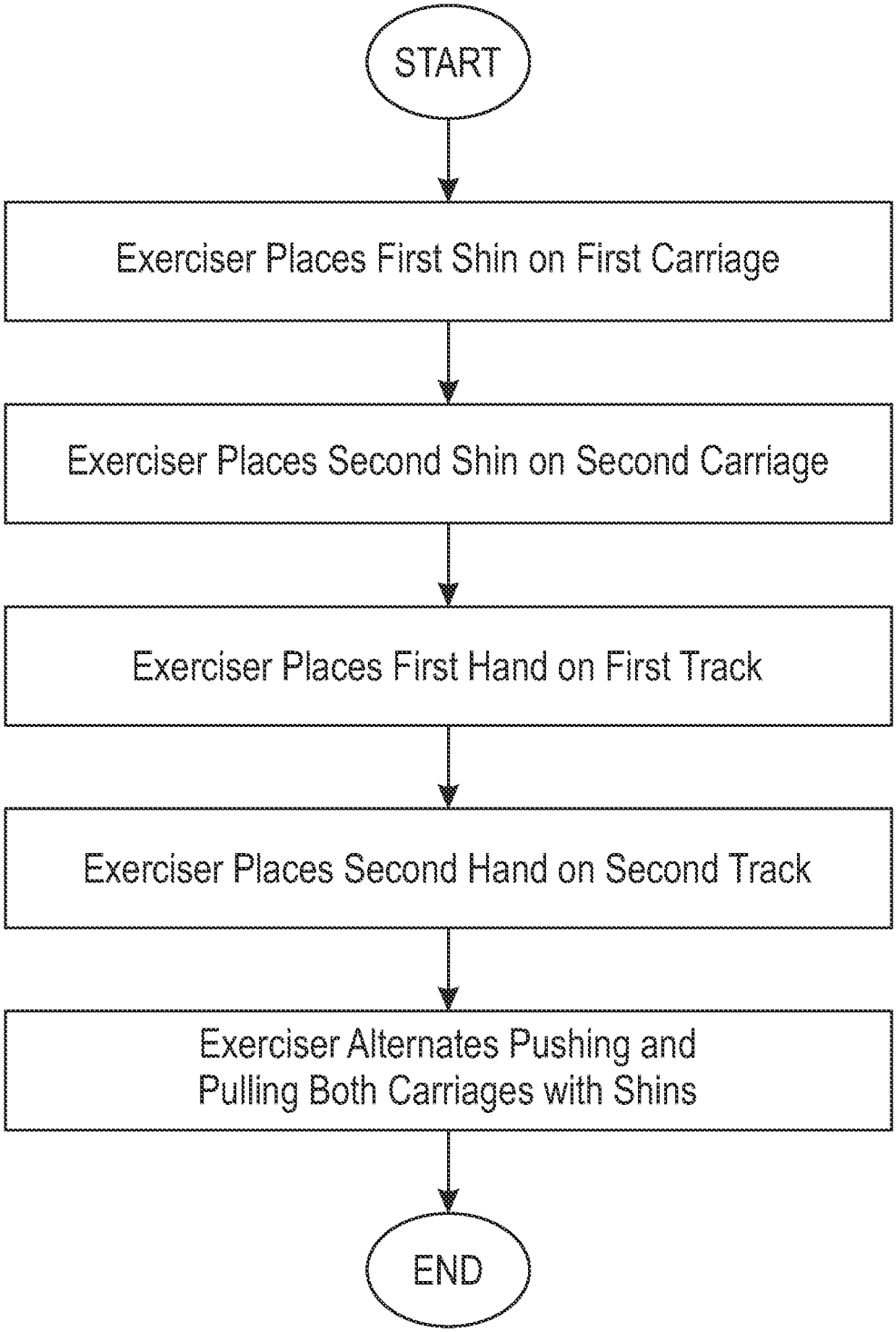
FIG. 18 is a flowchart illustrating another exemplary exercise movement to be performed on the pair of exercise machines in which the shins are on the carriages and the hands are on the tracks in accordance with an example embodiment.

FIGS. 9A, 9B, and 18 illustrate another exercise movement that can be performed on the pair of exercise machines 20, 30. As can be seen, the exerciser 12 has positioned his first leg 15*a* on the first carriage 23 of the first exercise machine 20 and his second leg 15*b* on the second carriage 33 of the second exercise machine 30. More specifically, the exerciser 12 has positioned his lower legs (e.g., shins) on the carriages 23, 33.

The hands 13*a*, 13*b* of the exerciser 12 are positioned on the tracks 21, 31 of the exercise machines 20, 30. As shown, the first hand 13*a* of the exerciser 12 is positioned on the first track 21 of the first exercise machine 20 at or near the first end 28 of the first exercise machine 20. Similarly, the second hand 13*b* of the exerciser 12 is positioned on the second track 31 of the second exercise machine 30 at or near the first end 38 of the second exercise machine 30. Thus, no portions of the exerciser's 12 body is in contact with the underlying surface 11, with all limbs 13*a*, 13*b*, 14*a*, 14*b*, 15*a*, 15*b*, 16*a*, 16*b* being positioned at various locations on the exercise machines 20, 30.

In this position, the exerciser 12 may perform exercise moves. The exerciser 12 may alternate between moving the first carriage 23 with his first leg 15*a* and moving the second carriage 33 with his second leg 15*b*. The carriages 23, 33 may be pushed and pulled along at least a portion of the tracks 21, 31 with the exerciser's 12 legs 15*a*, 15*b* repeatedly to perform the exercise movements. As with previous embodiments, different resistance levels may be applied to each carriage 23, 33 as needed by selectively connecting or disconnecting bias members 27, 37.

Figure 10A:
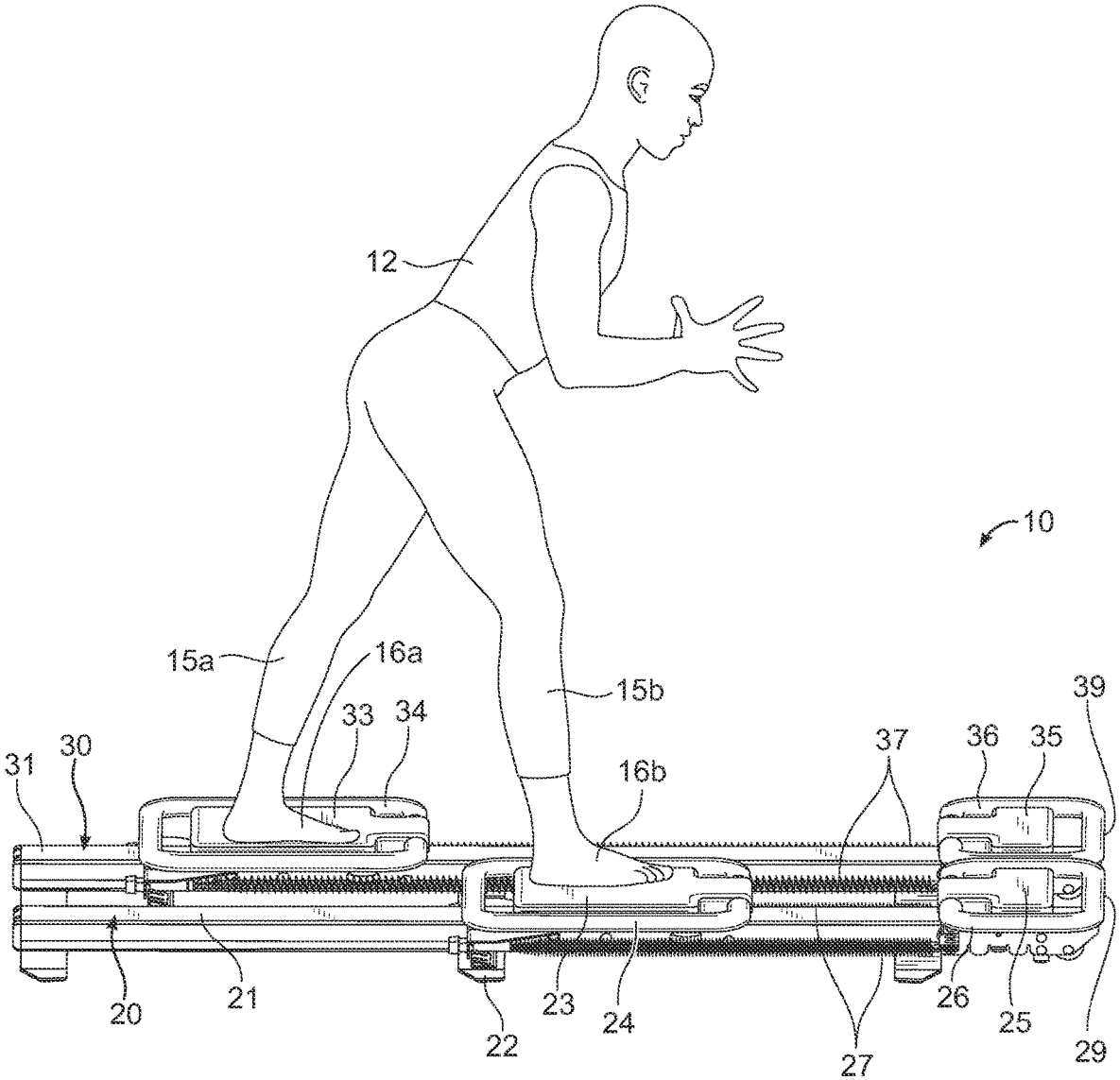
FIG. 10A is a side perspective view of an exerciser performing an exercise movement on the pair of exercise machines in accordance with an example embodiment.
Figure 10B:
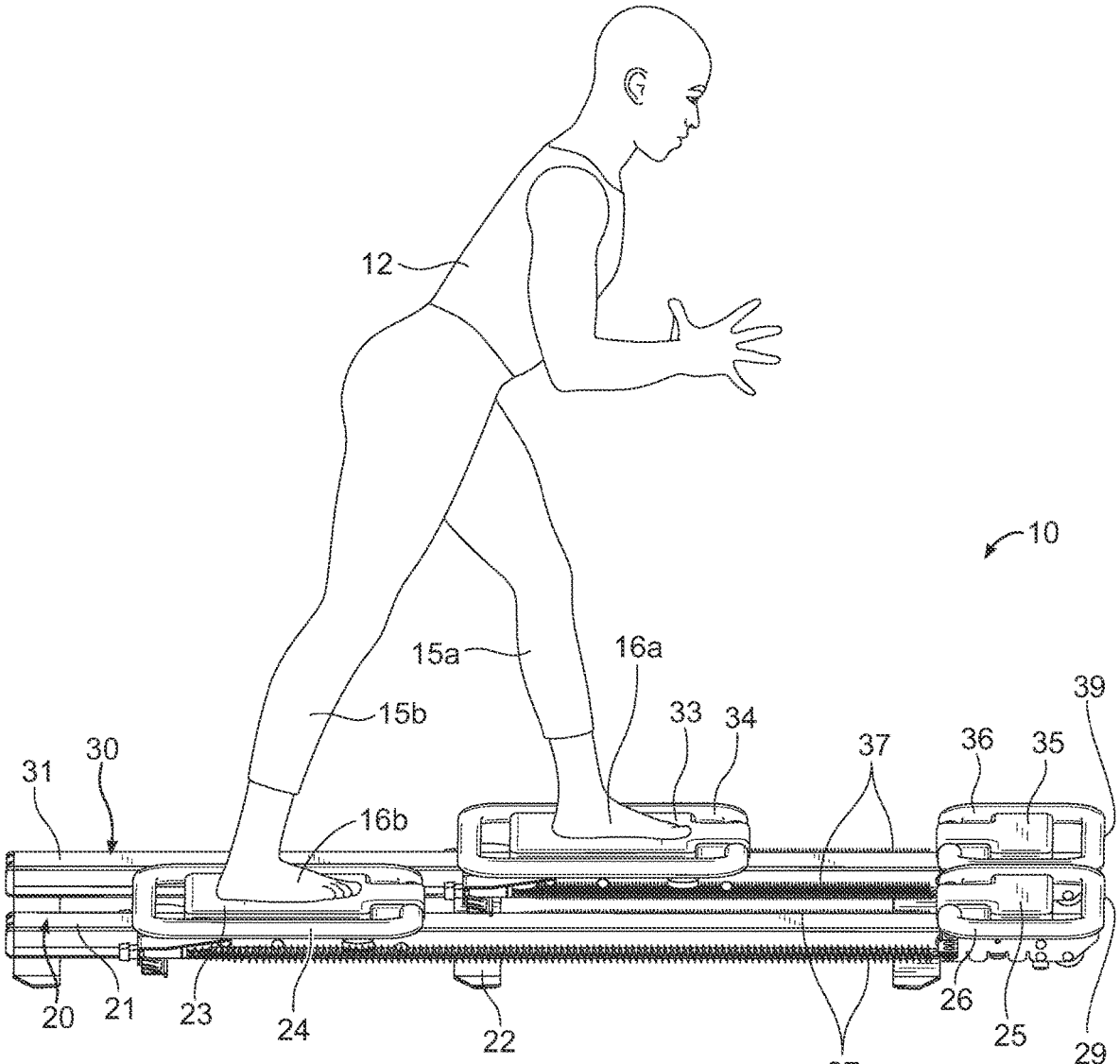
FIG. 10B is a side perspective view of an exerciser performing an exercise movement on the pair of exercise machines in accordance with an example embodiment.
Figure 11A:
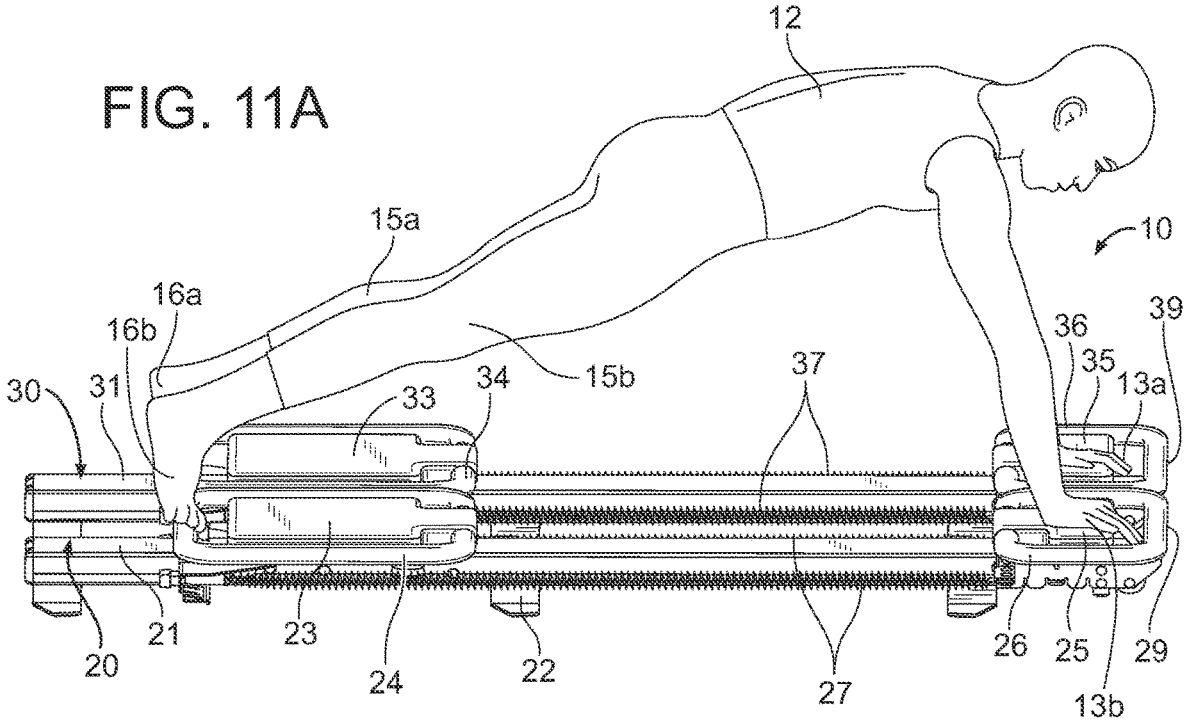
FIG. 11A is a side perspective view of an exerciser performing an exercise movement on the pair of exercise machines in accordance with an example embodiment.
Figure 11B:
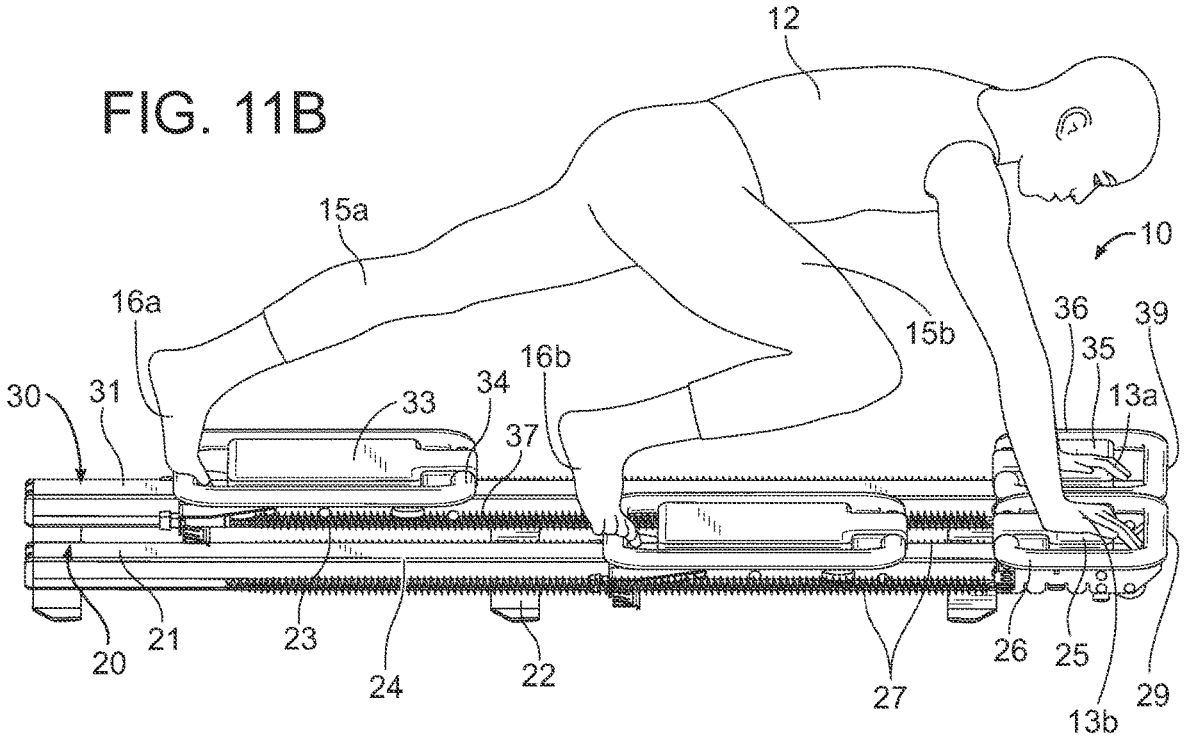
FIG. 11B is a side perspective view of an exerciser performing an exercise movement on the pair of exercise machines in accordance with an example embodiment.
Figure 11C:
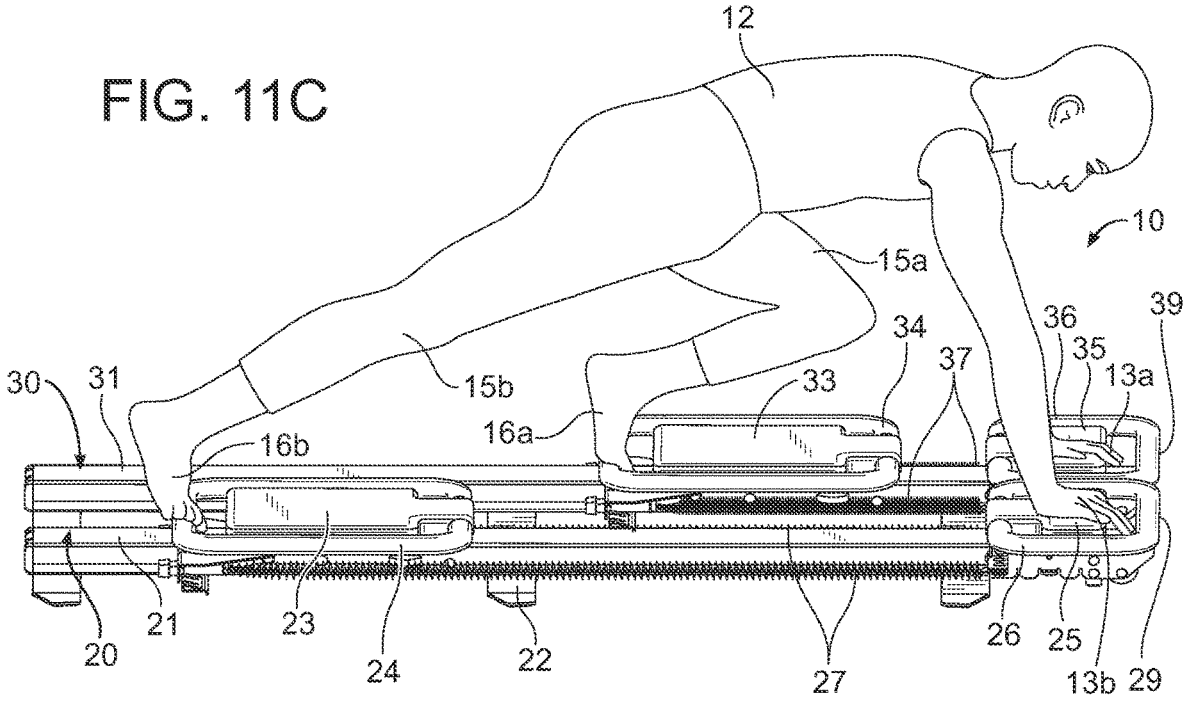
FIG. 11C is a side perspective view of an exerciser performing an exercise movement on the pair of exercise machines in accordance with an example embodiment.
Figure 19:
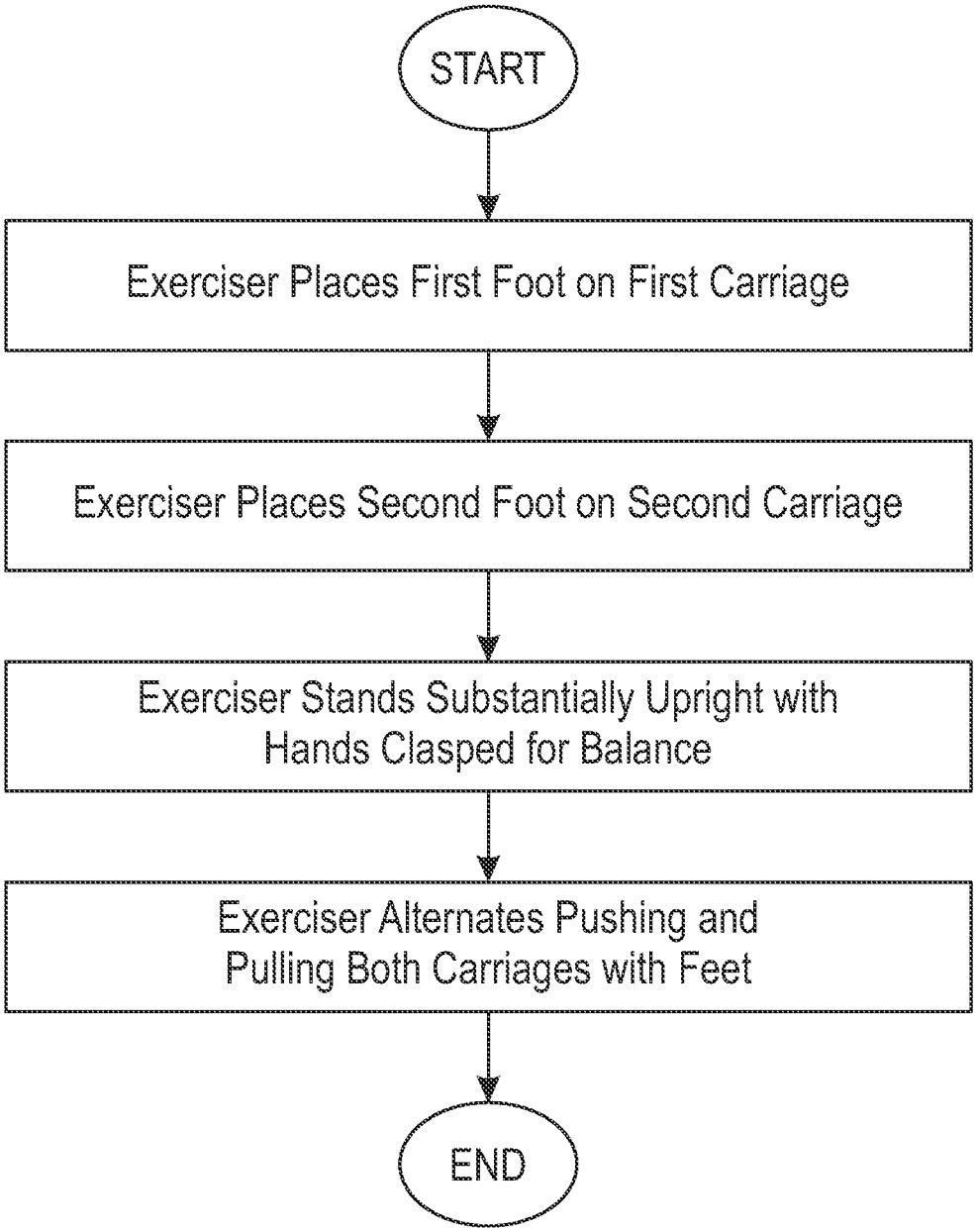
FIG. 19 is a flowchart illustrating another exemplary exercise movement to be performed on the pair of exercise machines in which the feet are on the carriages and the exerciser is standing substantially upright in accordance with an example embodiment.
Figure 20:
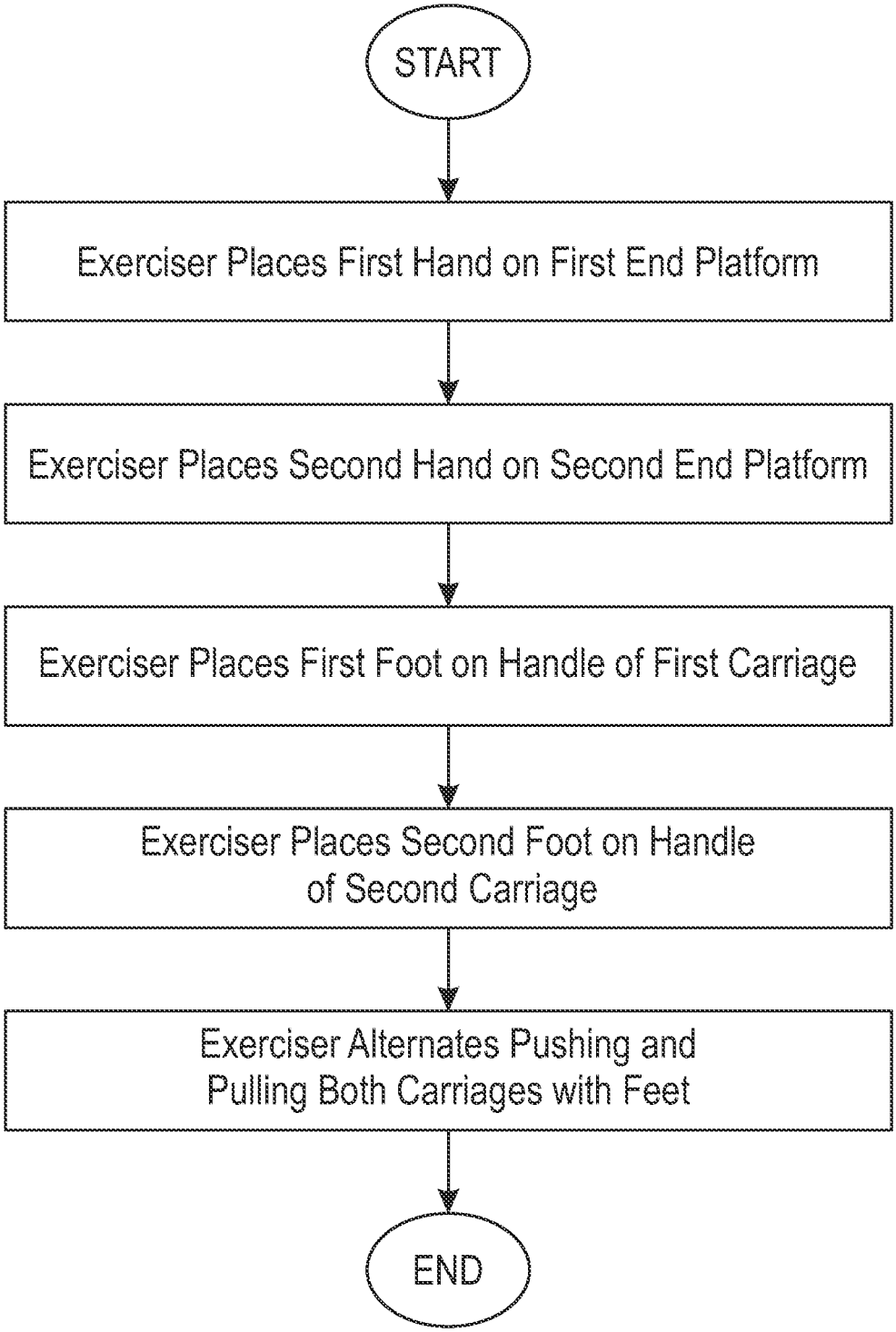
FIG. 20 is a flowchart illustrating another exemplary exercise movement to be performed on the pair of exercise machines in which the hands are on the end platforms and the feet are on the carriage handles in accordance with an example embodiment.

FIGS. 10A, 10B, and 19 illustrate another exercise movement that can be performed on the pair of exercise machines 20, 30. As can be seen, the exerciser 12 is standing upright or substantially upright, with his first foot 16*a* positioned on the first carriage 23 of the first exercise machine 20 and his second foot 16*b* positioned on the second carriage 33 of the second exercise machine 30. The exerciser 12 has not positioned or placed his hands 13*a*, 13*b* on any surface, but instead is standing upright or substantially upright. The hands 13*a*, 13*b* may be clasped together as shown to aid with balance when performing the exercise movements.

In this position, the exerciser 12 may perform exercise moves. The exerciser 12 may alternate between moving the first carriage 23 with his first foot 16*a* and moving the second carriage 33 with his second foot 16*b*. The carriages 23, 33 may be pushed and pulled along all or a portion of the tracks 21, 31 with the exerciser's 12 feet 16*a*, 16*b* repeatedly to perform the exercise movements. As with previous embodiments, different resistance levels may be applied to each carriage 23, 33 as needed by selectively connecting or disconnecting bias members 27, 37.

FIGS. 11A, 11B, 11C, and 20 illustrate another exercise movement that can be performed on the pair of exercise machines 20, 30. As can be seen, the exerciser 12 is in a "push-up" body position but is not in contact with the surface 11 underlying the exercise machines 20, 30. Instead, all body parts of the exerciser 12, including all limbs 13*a*, 13*b*, 14*a*, 14*b*, 15*a*, 15*b*, 16*a*, 16*b*, are not in contact with the surface 11.

Continuing to reference FIGS. 11A, 11B, 11C, and 20 the exerciser 12 has positioned his first hand 13*a* on the first end platform 25 of the first exercise machine 20 and positioned his second hand 13*b* on the second end platform 35 of the second exercise machine 30. The first foot 16*a* of the exerciser 12 has been positioned on the first carriage 23 of the first exercise machine 20 and the second foot 16*b* of the exerciser 12 has been positioned on the second carriage 33 of the second exercise machine 30.

The toes of the exerciser 12 are shown as curled around the carriage handles 24, 34 of the exercise machines 20, 30. More specifically, one or more of the toes on the first foot 16*a* have been positioned to engage with the first carriage handle 24 of the first carriage 23 and one or more toes of the second foot 16*b* have been positioned to engage with the second carriage handle 34 of the second carriage 33. In alternate embodiments, the feet 16*a*, 16*b* may instead be positioned on the pads of the carriages 23, 33 rather than the carriage handles 24, 34.

In this position, the exerciser 12 may perform exercise moves. The exerciser 12 may alternate between moving the first carriage 23 with his first foot 16*a* and moving the second carriage 33 with his second foot 16*b*. The carriages 23, 33 may be pushed and pulled along all or a portion of the tracks 21, 31 with the exerciser's 12 feet 16*a*, 16*b* repeatedly to perform the exercise movements. During all movements, the exerciser 12 maintains his hands 13*a*, 13*b* on the end platforms 25, 35 for stability. As with previous embodiments, different resistance levels may be applied to each carriage 23, 33 as needed by selectively connecting or disconnecting bias members 27, 37.

Figure 12A:
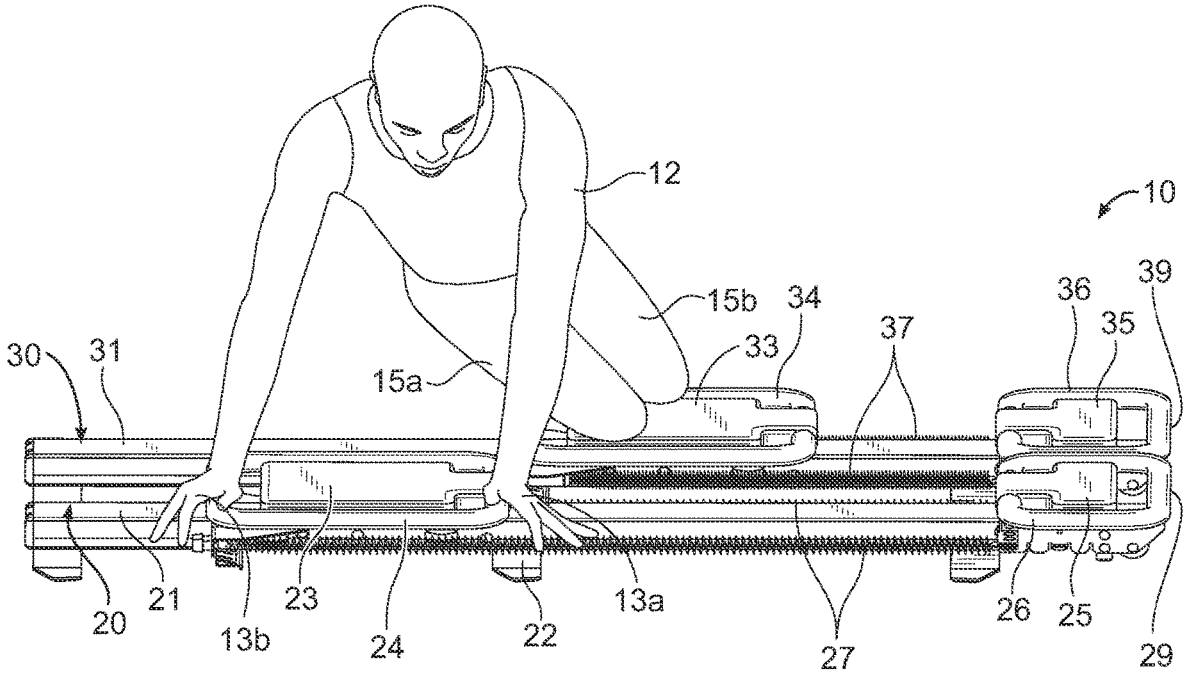
FIG. 12A is a side perspective view of an exerciser performing an exercise movement on the pair of exercise machines in accordance with an example embodiment.
Figure 12B:
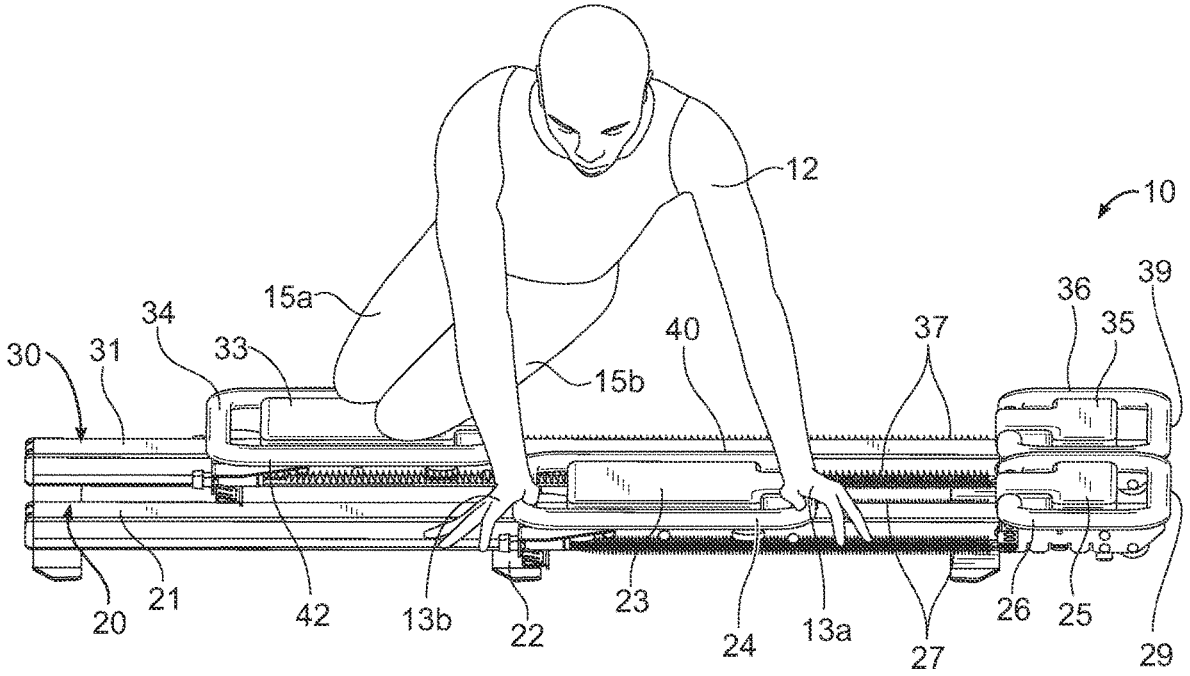
FIG. 12B is a side perspective view of an exerciser performing an exercise movement on the pair of exercise machines in accordance with an example embodiment.
Figure 21:
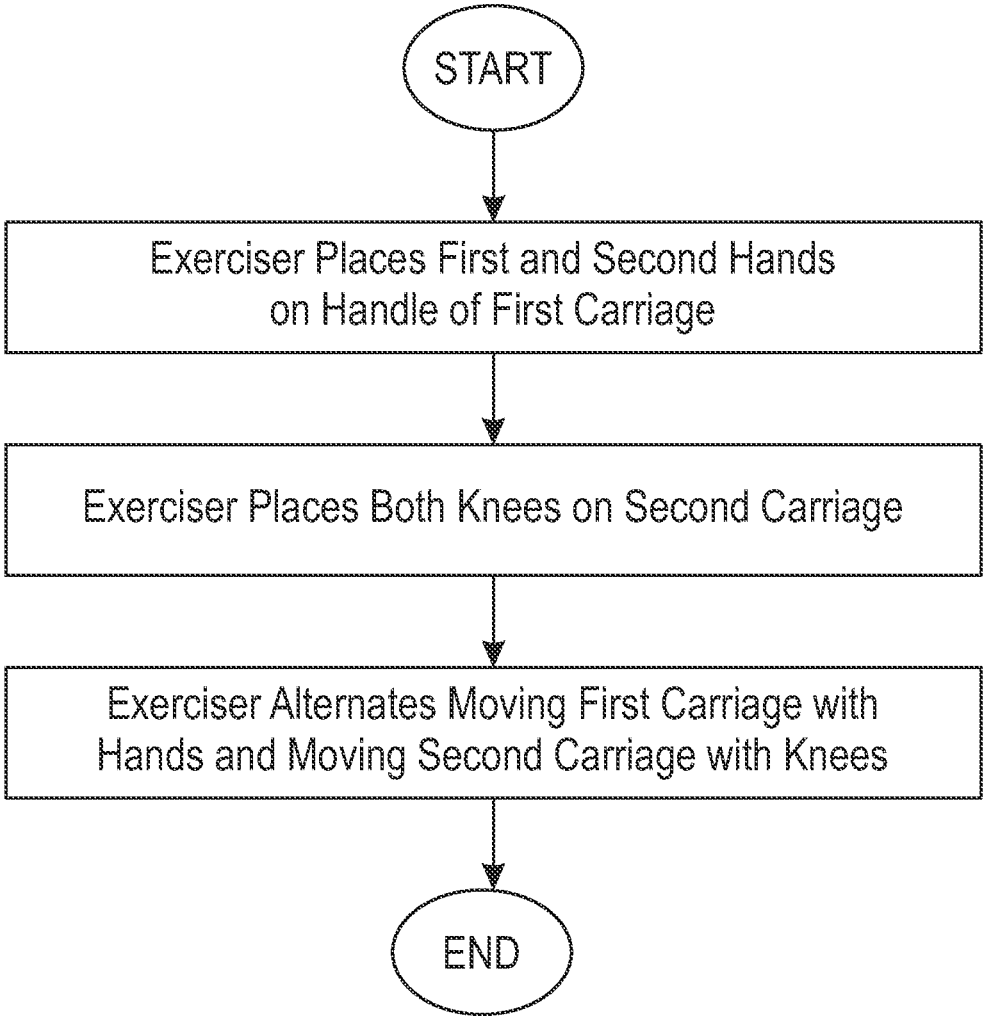
FIG. 21 is a flowchart illustrating another exemplary exercise movement to be performed on the pair of exercise machines in which the hands are on the first carriage and the knees are on the second carriage accordance with an example embodiment.

FIGS. 12A, 12B, and 21 illustrate another exercise movement that can be performed on the pair of exercise machines 20, 30. As can be seen, the exerciser 12 is only using the carriages 23, 33 with this exercise while maintain his body off the surface 11 underlying the exercise machines 20, 30. The exerciser 12 has positioned both legs 15*a*, 15*b* on the first carriage 23 of the first exercise machine 20 and both hands 13*a*, 13*b* on the second carriage 33 of the second exercise machine 30. More specifically, the knees and/or shins have been positioned on the first carriage 23. The hands 13*a*, 13*b* are shown as grasping the respective ends of the second carriage handle 34, though it should be appreciated that the hands 13*a*, 13*b* could instead by positioned on the pad of the second carriage handle 34 in some embodiments.

In this position, the exerciser 12 may perform exercise moves. The exerciser 12 may alternate between moving the first carriage 23 with his legs 15*a*, 15*b* and moving the second carriage 33 with his hands 13*a*, 13*b*. The carriages 23, 33 may be pushed and pulled along all or a portion of the tracks 21, 31 with the exerciser's 12 hands 13*a*, 13*b* and legs 15*a*, 15*b* repeatedly to perform the exercise movements. As with previous embodiments, different resistance levels may be applied to each carriage 23, 33 as needed by selectively connecting or disconnecting bias members 27, 37.

Figure 13A:
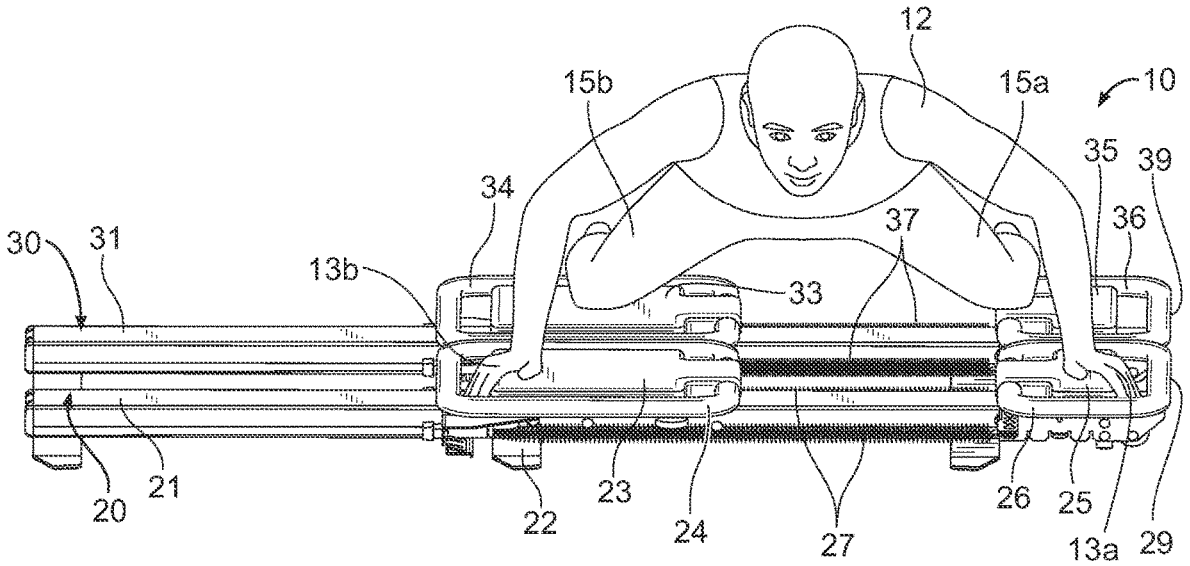
FIG. 13A is a side perspective view of an exerciser performing an exercise movement on the pair of exercise machines in accordance with an example embodiment.
Figure 13B:
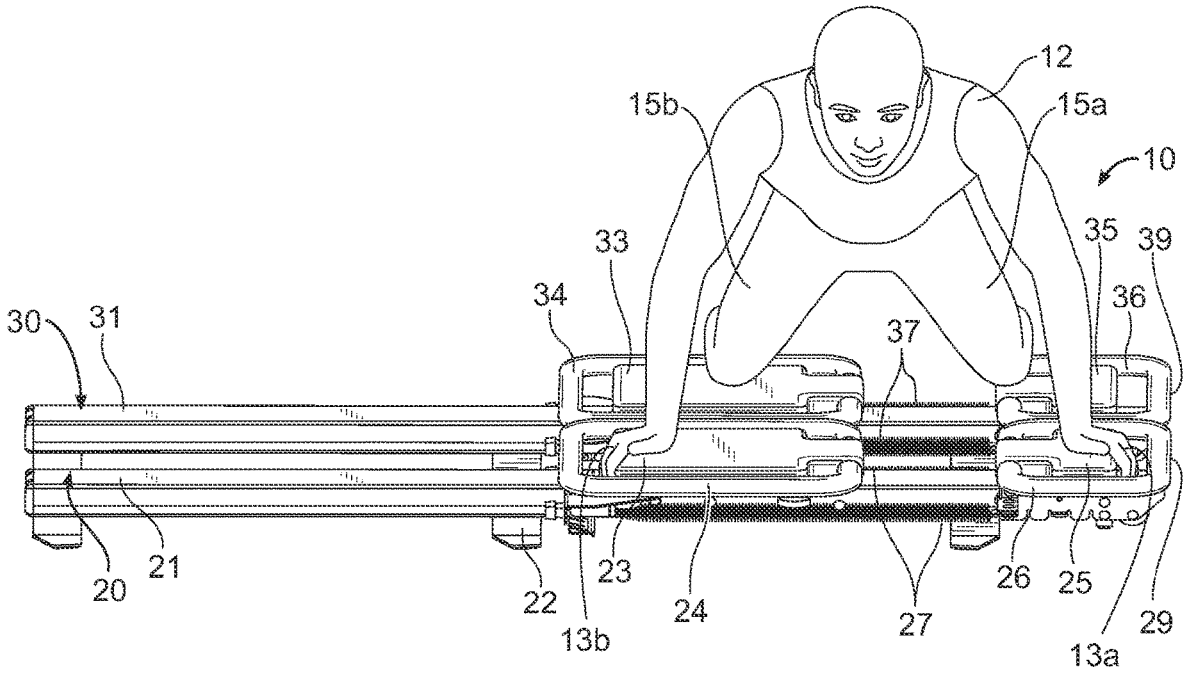
FIG. 13B is a side perspective view of an exerciser performing an exercise movement on the pair of exercise machines in accordance with an example embodiment.
Figure 22:
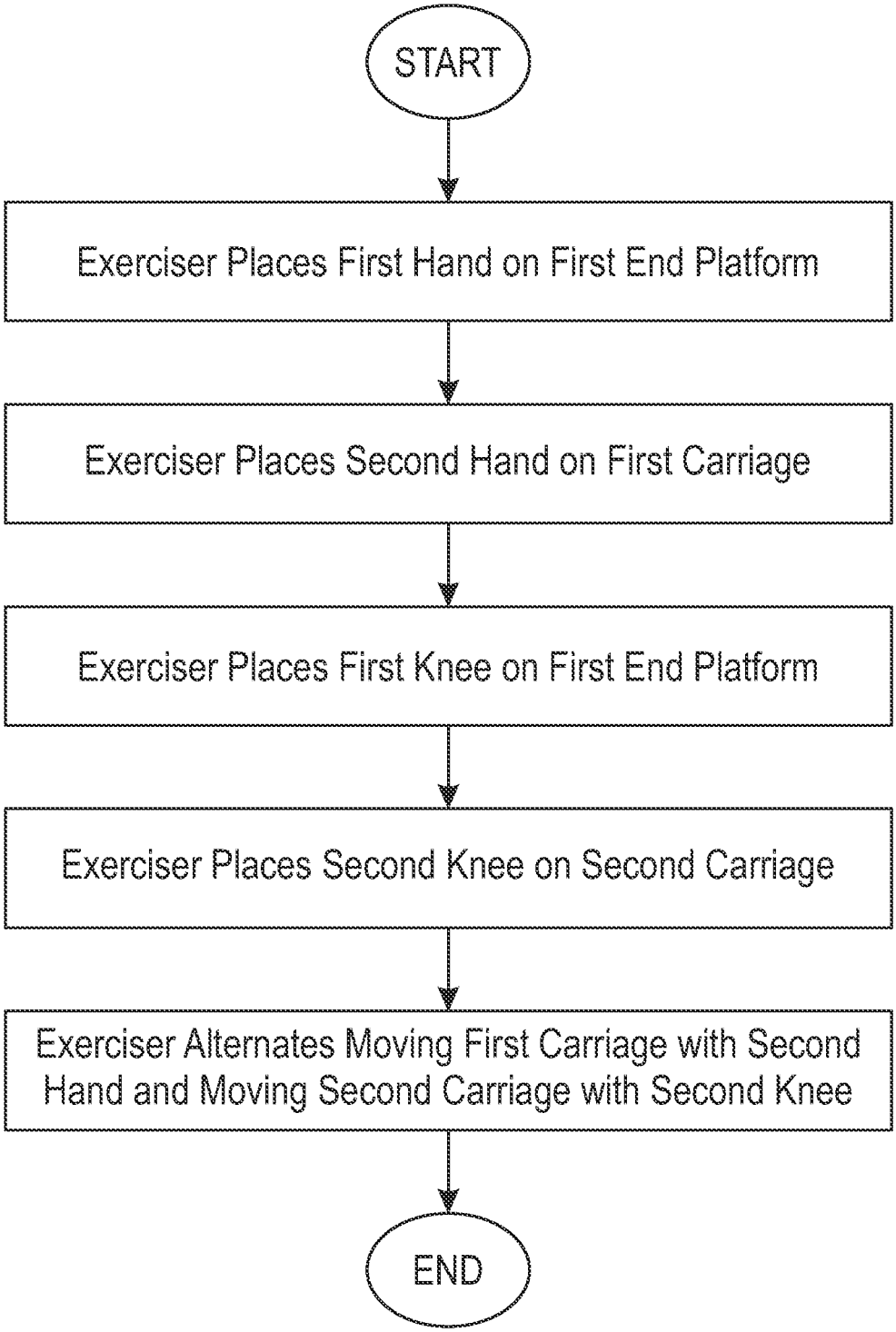
FIG. 22 is a flowchart illustrating another exemplary exercise movement to be performed on the pair of exercise machines in accordance in which hands are on the first end platform and first carriage and the knees are on the second end platform and second carriage with an example embodiment.

FIGS. 13A, 13B, and 22 illustrate another exercise movement that can be performed on the pair of exercise machines 20, 30. As can be seen, the exerciser 12 has positioned his first leg 15*a* on the first carriage 23 of the first exercise machine 20 and has positioned his second leg 15*b* on the first end platform 25 of the first exercise machine 20. Similarly, the exerciser 12 has positioned his first hand 13*a* on the second carriage 33 of the second exercise machine 30 and has positioned his second hand 13*b* on the second end platform 35 of the second exercise machine 30. No portion of the exerciser's 12 body is in contact with the underlying surface 11.

In this position, the exerciser 12 may perform exercise moves. The exerciser 12 may alternate between moving the first carriage 23 of the first exercise machine 20 with his first leg 15*a* and moving the second carriage 33 of the second exercise machine 30 with his first hand 13*a*. The carriages 23, 33 may be pushed and pulled along all or a portion of the tracks 21, 31 with the exerciser's 12 first hand 13*a* and first leg 15*a*, with the other hand 13*b* and leg 15*b* maintaining positioning on the end platforms 25, 35. As with previous embodiments, different resistance levels may be applied to each carriage 23, 33 as needed by selectively connecting or disconnecting bias members 27, 37.

Figure 14A:
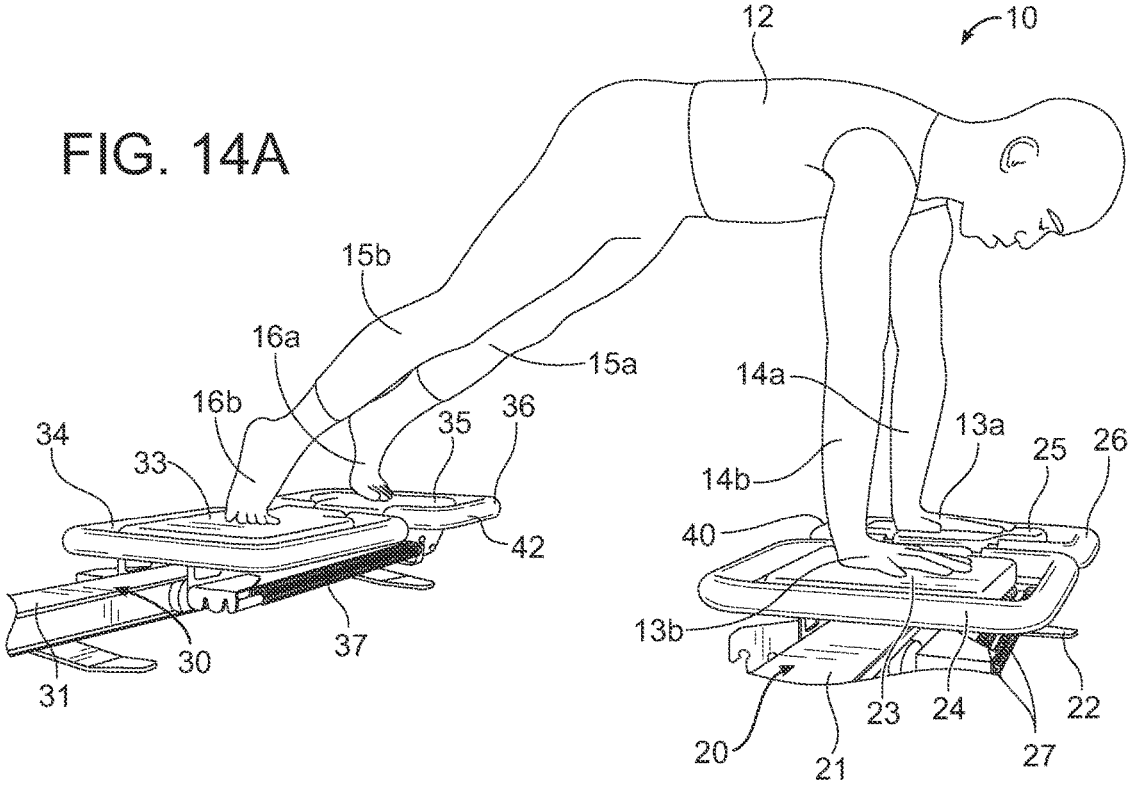
FIG. 14A is a side perspective view of an exerciser performing an exercise movement on the pair of exercise machines in accordance with an example embodiment.
Figure 14B:
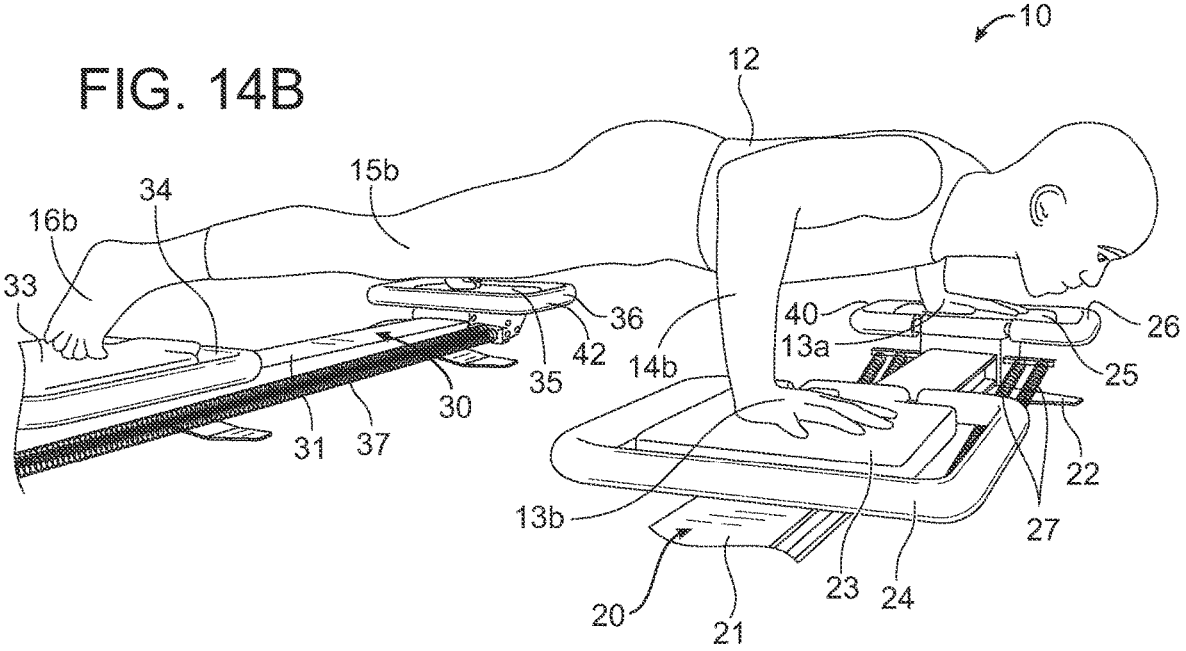
FIG. 14B is a side perspective view of an exerciser performing an exercise movement on the pair of exercise machines in accordance with an example embodiment.
Figure 14C:
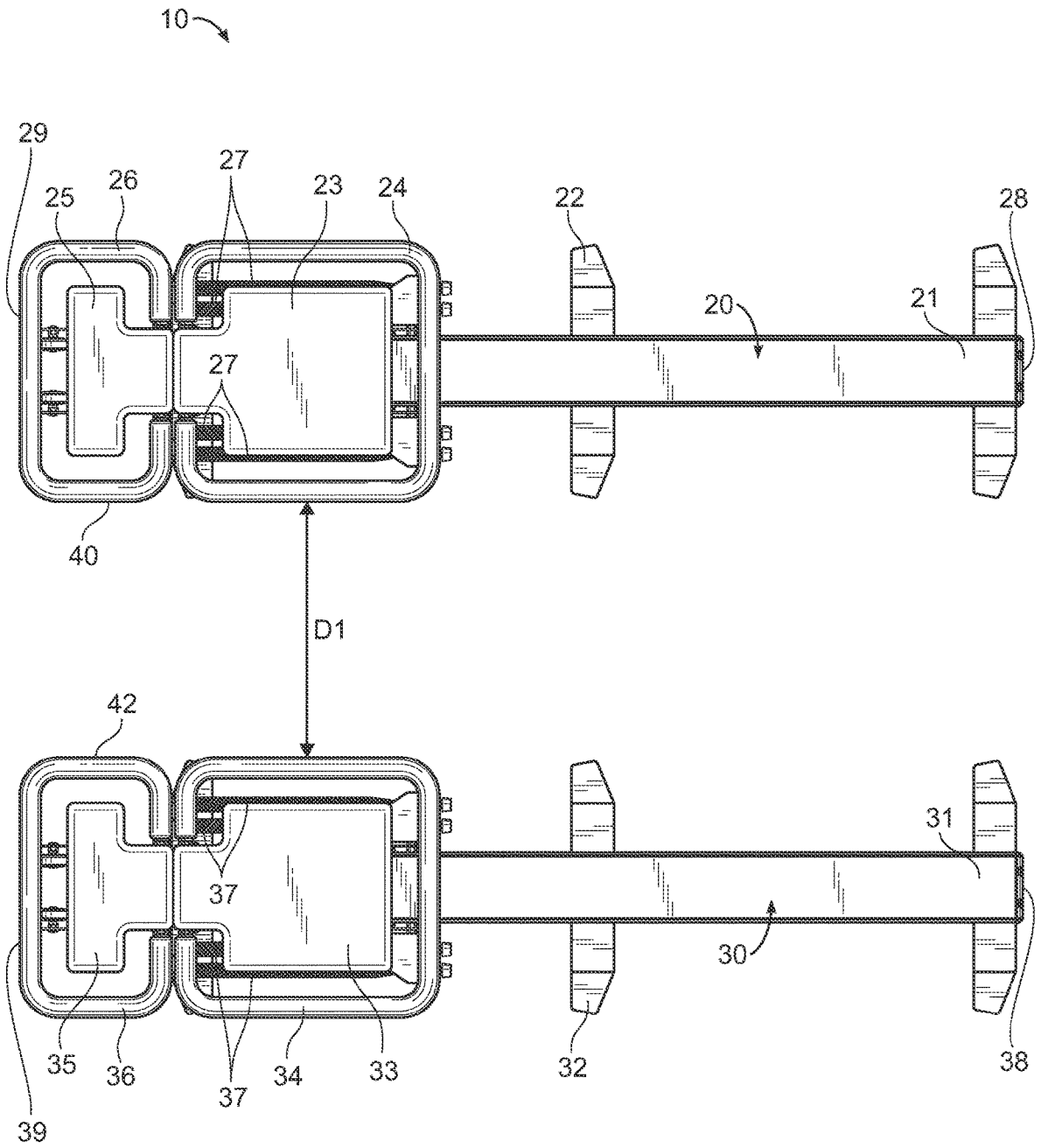
FIG. 14C is a top view of a pair of distally-spaced exercise machines in accordance with an example embodiment.
Figure 23:
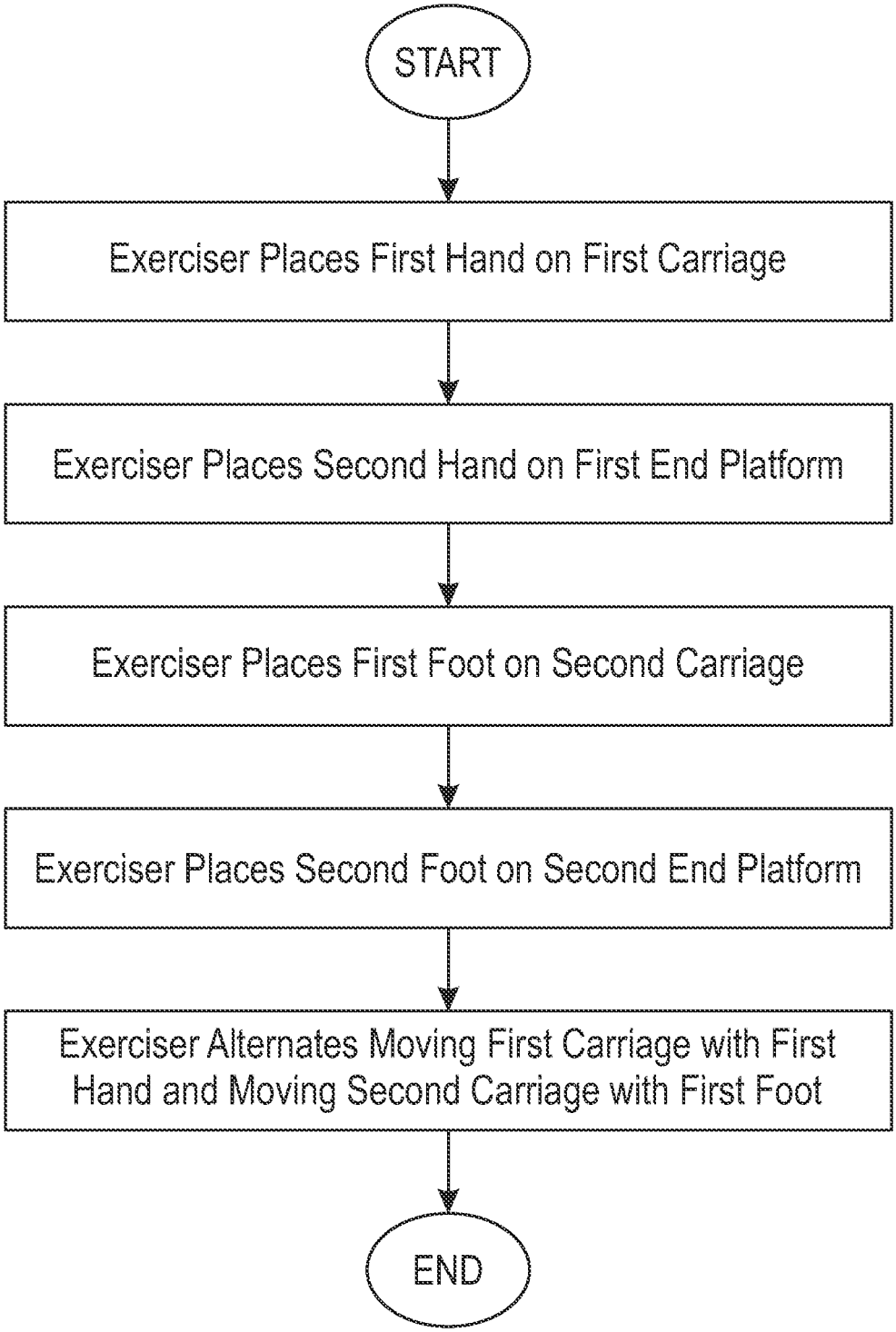
FIG. 23 is a flowchart illustrating another exemplary exercise movement to be performed on the pair of exercise machines in which the hands are on the first carriage and first end platform and the feet are on the second carriage and second end platform in accordance with an example embodiment.

FIGS. 14A, 14B, and 23 illustrate yet another exercise movement that can be performed on the pair of exercise machines 20, 30. As seen in these figures and in FIG. 14C, the exercise machines 20, 30 have been moved further apart than with previous exercise movements. The first foot 16*a* has been positioned on the first end platform 25 of the first exercise machine 20 and the second foot 16*b* has been positioned on the first carriage 23 of the first exercise machine 20. The first hand 13*a* has been positioned on the second end platform 35 of the second exercise machine 30 and the second hand 13*b* has been positioned on the second carriage 33 of the second exercise machine 30. No portion of the exerciser's 12 body is in contact with the underlying surface 11.

In this position, the exerciser 12 may perform exercise moves. The exerciser 12 may alternate between moving the first carriage 23 of the first exercise machine 20 with his second foot 16*b* and moving the second carriage 33 of the second exercise machine 30 with his second hand 13*b*. The second hand 13*b* and second foot 16*b* may move in concert with each other, or may alternate. The carriages 23, 33 may be pushed and pulled along all or a portion of the tracks 21, 31 with the exerciser's second hand 13*b* and second foot 16*b*, with the other hand 13*a* and foot 16*a* maintaining positioning on the end platforms 25, 35. As with previous embodiments, different resistance levels may be applied to each carriage 23, 33 as needed by selectively connecting or disconnecting bias members 27, 37.

Unless otherwise defined, all technical and scientific terms used herein have the same meaning as commonly understood by one of ordinary skill in the art to which this invention belongs. Although methods and materials similar to or equivalent to those described herein can be used in the practice or testing of the system and method of using two exercise machines, suitable methods and materials are described above. All publications, patent applications, patents, and other references mentioned herein are incorporated by reference in their entirety to the extent allowed by applicable law and regulations. The system and method of using two exercise machines may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A method of exercising with a first exercise machine and a second exercise machine wherein the first exercise machine is not connected to the second exercise machine, wherein the first exercise machine comprises a first track, a first carriage movably connected to the first track, a first end, a second end, and a first longitudinal axis extending therebetween, and wherein the second exercise machine comprises a second track, a second carriage movably connected to the second track, a first end, a second end, and a second longitudinal axis extend therebetween, and wherein the first longitudinal axis of the first exercise machine is parallel with the second longitudinal axis of the second exercise machine, the method comprising the steps of:

positioning a first limb of an exerciser on the first carriage of the first exercise machine;

positioning a second limb of the exerciser on the second carriage of the second exercise machine;

wherein the first limb is comprised of a first hand of the exerciser and wherein the second limb is comprised of a second hand of the exerciser;

moving the first carriage along at least a portion of the first track of the first exercise machine with the first limb by the exerciser;

moving the second carriage of the second exercise machine along at least a portion of the second track with the second limb by the exerciser, wherein the first carriage of the first exercise machine moves independently with respect to the second carriage of the second exercise machine; and positioning a first foot and a second foot on a surface underlying the first exercise machine and the second exercise machine by the exerciser.

2. The method of claim 1, wherein the first end and the second end of the first exercise machine and the first end and the second end of the second exercise machine are on a common plane that is tangential to the first longitudinal axis and the second longitudinal axis.

3. A method of exercising with a first exercise machine and a second exercise machine, wherein the first exercise machine comprises a first track, a first carriage movably connected to the first track, a first end, a second end, and a first longitudinal axis extending therebetween, and wherein the second exercise machine comprises a second track, a second carriage movably connected to the second track, a first end, a second end, and a second longitudinal axis extend therebetween, and wherein the first longitudinal axis of the first exercise machine is parallel with the second longitudinal axis of the second exercise machine, the method comprising the steps of:

positioning a first limb of an exerciser on the first carriage of the first exercise machine;

positioning a second limb of the exerciser on the second carriage of the second exercise machine;

positioning a third limb of the exerciser on a surface underlying the first exercise machine;

positioning a fourth limb of the exerciser on a surface underlying the second exercise machine;

moving the first carriage along at least a portion of the first track of the first exercise machine with the first limb by the exerciser; and moving the second carriage of the second exercise machine along at least a portion of the second track with the second limb by the exerciser, wherein the first carriage of the first exercise machine moves independently with respect to the second carriage of the second exercise machine.

4. The method of claim 3, wherein the first limb is comprised of a first foot of the exerciser, and wherein the second limb is comprised of a second foot of the exerciser.

5. The method of claim 3, wherein the first limb is comprised of a first hand of the exerciser, and wherein the second limb is comprised of a second hand of the exerciser.

6. A method of exercising with a first exercise machine and a second exercise machine, wherein the first exercise machine comprises a first track, a first end platform directly or indirectly connected to the first track, a first carriage movably connected to the first track, a first end, a second end, and a first longitudinal axis extending therebetween, and wherein the second exercise machine comprises a second track, a second end platform directly or indirectly connected to the second track, a second carriage movably connected to the second track, a first end, a second end, and a second longitudinal axis extend therebetween, and wherein the first longitudinal axis of the first exercise machine is parallel with the second longitudinal axis of the second exercise machine, the method comprising the steps of:

positioning a first limb of an exerciser on the first carriage or the first end platform of the first exercise machine;

positioning a second limb of the exerciser on the second carriage or the second end platform of the second exercise machine;

positioning a third limb of the exerciser on the first carriage or the first end platform of the first exercise machine;

positioning a fourth limb of the exerciser on the second carriage or the second end platform of the second exercise machine;

moving the first carriage along at least a portion of the first track of the first exercise machine or moving the second carriage of the second exercise machine along at least a portion of the second track, wherein the first carriage of the first exercise machine moves independently with respect to the second carriage of the second exercise machine.

7. The method of claim 6, wherein the first limb is comprised of a first foot of the exerciser, and wherein the second limb is comprised of a second foot of the exerciser.

8. The method of claim 7, wherein the first limb is comprised of a first hand of the exerciser, and wherein the second limb is comprised of a second hand of the exerciser.

9. The method of claim 7, wherein the first limb is comprised of a first foot or a first knee of the exerciser, wherein the second limb is comprised of a first hand of the exerciser, wherein the third limb is comprised of a second foot or a second knee of the exerciser, and wherein the fourth limb is comprised of a second hand of the exerciser.

10. A method of exercising with a first exercise machine and a second exercise machine wherein the first exercise machine is not connected to the second exercise machine, wherein the first exercise machine comprises a first track, a first carriage movably connected to the first track, a first end, a second end, and a first longitudinal axis extending therebetween, and wherein the second exercise machine comprises a second track, a second carriage movably connected to the second track, a first end, a second end, and a second longitudinal axis extend therebetween, and wherein the first longitudinal axis of the first exercise machine is parallel with the second longitudinal axis of the second exercise machine, the method comprising the steps of:

positioning a first limb of an exerciser on the first carriage of the first exercise machine;

positioning a second limb of the exerciser on the second carriage of the second exercise machine;

wherein the first limb is comprised of a first foot of the exerciser and wherein the second limb is comprised of a second foot of the exerciser;

moving the first carriage along at least a portion of the first track of the first exercise machine with the first limb by the exerciser;

moving the second carriage of the second exercise machine along at least a portion of the second track with the second limb by the exerciser, wherein the first carriage of the first exercise machine moves independently with respect to the second carriage of the second exercise machine; and positioning a first hand and a second hand on a surface underlying the first exercise machine and the second exercise machine by the exerciser.

11. The method of claim 10, wherein the first end and the second end of the first exercise machine and the first end and the second end of the second exercise machine are on a common plane that is tangential to the first longitudinal axis and the second longitudinal axis.

12. A method of exercising with a first exercise machine and a second exercise machine wherein the first exercise machine is not connected to the second exercise machine, wherein the first exercise machine comprises a first track, a first carriage movably connected to the first track, a first end, a second end, and a first longitudinal axis extending therebetween, and wherein the second exercise machine comprises a second track, a second carriage movably connected to the second track, a first end, a second end, and a second longitudinal axis extend therebetween, and wherein the first longitudinal axis of the first exercise machine is parallel with the second longitudinal axis of the second exercise machine, the method comprising the steps of:

positioning a first limb of an exerciser on the first carriage of the first exercise machine;

positioning a second limb of the exerciser on the second carriage of the second exercise machine;

wherein the first limb is comprised of a first knee of the exerciser and wherein the second limb is comprised of a first hand of the exerciser;

moving the first carriage along at least a portion of the first track of the first exercise machine with the first limb by the exerciser;

moving the second carriage of the second exercise machine along at least a portion of the second track with the second limb by the exerciser, wherein the first carriage of the first exercise machine moves independently with respect to the second carriage of the second exercise machine; and positioning a second knee on the first carriage of the first exercise machine by the exerciser.

13. The method of claim 12, wherein the first end and the second end of the first exercise machine and the first end and the second end of the second exercise machine are on a common plane that is tangential to the first longitudinal axis and the second longitudinal axis.

* * * * *